US005701942A

United States Patent [19]

Adachi et al.

[11] Patent Number: 5,701,942

[45] Date of Patent: Dec. 30, 1997

[54] SEMI-SOLID METAL PROCESSING METHOD AND A PROCESS FOR CASTING ALLOY BILLETS SUITABLE FOR THAT PROCESSING METHOD

[75] Inventors: Mitsuru Adachi; Hiroto Sasaki; Satoru Sato, all of Ube, Japan

[73] Assignee: Ube Industries, Ltd., Ube, Japan

[21] Appl. No.: 683,023

[22] Filed: Jul. 15, 1996

Related U.S. Application Data

[63] Continuation of Ser. No. 396,507, Mar. 1, 1995, abandoned.

[30] Foreign Application Priority Data

Sep. 9, 1994 [JP] Japan ..... 6-251148
Sep. 30, 1994 [JP] Japan ..... 6-271908

[51] Int. Cl.[6] ..... C22C 1/00; B22D 23/00; B22D 27/08

[52] U.S. Cl. ..... 164/71.1; 148/549; 148/550; 164/122; 164/900

[58] Field of Search ..... 164/71.1, 122, 164/122.1, 47, 900; 148/549, 550, 557, 689, 667

[56] References Cited

U.S. PATENT DOCUMENTS

| | | | |
|---|---|---|---|
| 3,902,544 | 9/1975 | Flemings et al. . | |
| 4,410,370 | 10/1983 | Baba et al. | 148/11.5 |
| 4,415,374 | 11/1983 | Young et al. . | |
| 4,457,354 | 7/1984 | Dantzig et al. . | |

(List continued on next page.)

FOREIGN PATENT DOCUMENTS

| | | |
|---|---|---|
| 0 080 786 | 6/1983 | European Pat. Off. . |
| 0554 808 | 8/1993 | European Pat. Off. . |
| 6-73485 | 3/1994 | Japan . |
| 7-76740 | 3/1995 | Japan . |
| WO 87/06957 | 11/1987 | WIPO . |

OTHER PUBLICATIONS

G. Wan et al, "Thixoforming of Aluminum Alloys Using Modified Chemical, Grain Refinement for Billet Production", International Conference Aluminum Alloys: New Process Technologies, Marina di Ravenna, Italy, 3–4 Jun. 1993, pp. 1–12.

Haavard Gjestland, "Thixotropic Casting of Magnesium Using a Conventional Casting Machine", (Norsk hydro a.s.): D0244B SAE Tech Pap Ser (Soc Automot Eng) (USA) [SAE–930753] 7P (1993), pp. 101–106.

Kenneth P. Young et al, "Semi–Solid Metal Cast Aluminium Automotive Components", The 3rd Int'l Conf. on Semi–Solid Processing of Alloys and Composites 1994.6, pp. 155–177.

*Primary Examiner*—J. Reed Batten, Jr.
*Attorney, Agent, or Firm*—Frishauf, Holtz, Goodman, Langer & Chick, P.C.

[57] ABSTRACT

A magnesium or aluminum alloy melt having a composition within maximum solubility limits is poured into a mold at a temperature exceeding the alloy liquidus line, but not higher by more than 30° C., the melt is cooled at a rate of at least 1.0° C./sec to form a billet, the billet is heated at a rate of at least 0.5° C./min in a range bound by the alloy solubility line and the alloy solidus line and further heated to a temperature above the alloy solidus line and is maintained at that temperature for 5 to 60 minutes, thereby spheroidizing primary crystals thereof, the billet is then further heated to a temperature below the alloy liquidus line and the semi-solid billet is shaped under pressure. Alternatively, a hypo-eutectic aluminum alloy melt having a composition at or above maximum solubility limits is poured into a billet-forming mold at a temperature exceeding the alloy liquidus line, but not higher by more than 30° C. and the melt is cooled at a rate of at least 1.0° C./sec to form a billet, the billet is then heated to a temperature above the alloy eutectic point, the holding time and temperature are selected such that the liquid-phase content of the billet is adjusted to 20% to 80% and primary crystals thereof are spheroidized and, the semi-solid billet having the adjusted liquid-phase content is shaped under pressure.

19 Claims, 17 Drawing Sheets

U.S. PATENT DOCUMENTS

| | | | |
|---|---|---|---|
| 4,462,843 | 7/1984 | Baba et al. | 148/11.5 |
| 4,598,754 | 7/1986 | Yen et al. | 164/4.1 |
| 4,621,676 | 11/1986 | Steward | 164/900 |
| 4,687,042 | 8/1987 | Young | 164/900 |
| 4,709,461 | 12/1987 | Freeman, Jr. | 164/122 |
| 4,832,112 | 5/1989 | Brinegar et al. | 164/65 |
| 5,009,844 | 4/1991 | Laxmanan . | |
| 5,055,256 | 10/1991 | Sigworth et al. | 420/548 |
| 5,066,324 | 11/1991 | Perepezko et al. | 75/335 |
| 5,143,564 | 9/1992 | Gruzleski et al. | 148/420 |
| 5,178,686 | 1/1993 | Schmid et al. | 148/439 |
| 5,180,447 | 1/1993 | Sigworth et al. | 148/437 |
| 5,287,910 | 2/1994 | Coluin et al. | 164/63 |

(×50) 200μm (×50) 200μm (×100) 100μm (×100) 100μm

○ HEATED (550℃) MOLD WITHOUT Ti OR B

● COLD MOLD WITHOUT Ti OR B

△ HEATED (550℃) MOLD WITH THE ADDITION OF Ti AND B

▲ COLD MOLD WITH THE ADDITION OF Ti AND B

× COLD MOLD WITHOUT Ti OR B BUT WITH VIBRATION

100 μm

100 μm

100 μm

100 μm

SEMI-SOLID METAL PROCESSING METHOD AND A PROCESS FOR CASTING ALLOY BILLETS SUITABLE FOR THAT PROCESSING METHOD

This application is a Continuation of application Ser. No. 08/396,507, filed Mar. 1, 1995 and now abandoned.

BACKGROUND OF THE INVENTION

This invention relates to a method of processing semi-solid magnesium or aluminum alloys, as well as a process for casting alloy billets suitable for said semi-solid processing method. More particularly, the invention relates to a method in which a billet having fine, equiaxed crystals that have been prepared by an improved casting method is heated to a semi-solid temperature region and then shaped under pressure as it retains a spheroidized structure. The invention also relates to a process for casting magnesium or aluminum billets suitable for said semi-solid processing method.

Thixotropic casting is superior to the conventional casting techniques in that it causes fewer casting defects and segregations, produces a uniform metal structure, enables molds to be used for a prolonged life and provides for a shorter molding cycle. Because of these advantages, thixotropic casting is gaining increasing interest among researchers. The billets used in this forming method (hereunder designated as "Process A") are prepared either by performing mechanical or electromagnetic stirring in the semi-solid temperature region or by taking advantage of post-working recrystallization.

Methods are also known that perform semi-solid shaping using materials formed by conventional casting techniques. They include the following: a method characterized by adding Zr as a grain refining agent to magnesium alloys which are inherently prone to create an equiaxed grain structure (this method is hereunder designated as "Process B"); a method characterized by using carbon-base grain refining agents in magnesium alloys (this method is hereunder designated as "Process C"); and a method in which a master alloy such as Al-5% Ti-1% B is added as a grain refining agent to aluminum alloys in amounts ranging from about 2 to 10 times as much as has been used conventionally (this method is hereunder designated as "Process D"). In each of these methods, the billet prepared is heated to a semi-solid temperature range so that the primary crystals are spheroidized, followed by shaping of the billet.

According to another known method, an alloy having a composition not exceeding the solubility limit is heated fairly rapidly to a temperature near the solidus line and, thereafter, in order to assure temperature uniformity throughout the billet and to prevent local melting, the billet is slowly heated to a suitable temperature above the solidus line at which it becomes soft enough to permit shaping (this method is hereunder designated as "Process E").

However, these prior art methods have their own problems. Process A, whether it depends on agitation or recrystallization, involves cumbersome operational procedures to increase the production cost. Process B as applied to magnesium alloys is not cost-effective since the price of Zr is high. In Process C, in order to insure that the effectiveness of carbon-base grain refining agents is fully exhibited, the concentration of Be which is an antioxidant element must be controlled at low levels, say, 7 ppm, but then the chance of oxidative burning occurring during heat treatment just prior to forming increases to cause operational inconveniences.

In aluminum alloys, crystal grains coarser than 500 μm will sometimes result by simple addition of grain refining agents and it is by no means easy to produce structures consisting of grains finer than 100 μm. To overcome this problem, Process D characterized by the addition of large amounts of grain refining agents has been proposed; however, in certain aluminum alloys such as A356, Ti and B have to be added as grain refining agents in respective amounts of at least 0.26% and 0.05% but, then, they are prone to settle out as $TiB_2$ on the bottom of the furnace; thus, Process D is not only difficult to implement on an industrial basis, but is also costly. Process E is a kind of thixotropic forming which is characterized in that the billet is slowly heated above the solidus line to insure uniform heating and spheroidization; however, an ordinary dendritic structure will not turn into a thixotropic structure (in which the proeutectic dendrite has been spheroidized) even if it is heated.

SUMMARY OF THE INVENTION

The present invention has been accomplished under these circumstances and has as an object providing a method that comprises the steps of preparing a billet comprising fine, equiaxed crystals by a simple procedure, then subjecting the billet to a specified heat treatment and thereafter forming a semi-solid metal to a shape.

Another object of the invention is to provide a process for producing alloy billets suitable for that semi-solid metal processing method.

The first object of the invention can be attained in accordance with either one of two aspects of the invention.

According to the first aspect, the melt of a magnesium or an aluminum alloy that has a composition within maximum solubility limits is cast into a billet-forming mold with care being taken to insure that the temperature of the melt as it is poured into said mold exceeds the liquidus line of the alloy but is not higher by more than 30° C. and said melt is cooled to solidify within said mold at a cooling rate of at least 1.0° C./sec over the solidification zone so as to form a billet and, subsequently, said billet is heated within said mold from the solubility line to the solidus line of the alloy at a rate of at least 0.5° C. /min and further heated to a temperature exceeding the solidus line of the alloy and held at that temperature for 5–60 minutes, thereby spheroidizing the primary crystals and, thereafter, said billet is further heated to a molding temperature below the liquidus line of the alloy and the semi-solid billet is fed into a shaping mold and shaped under pressure.

In an embodiment of this first aspect, the alloy is a magnesium alloy selected from the group consisting of a magnesium alloy which contains 0.005–0.1% Sr, a magnesium alloy which contains 0.05–0.3% Ca and a magnesium alloy which contains 0.01–1.5% Si and 0.005–0.1% Sr.

In another embodiment of said first aspect, the billet-forming mold is supplied with the molten alloy as small vibrations are applied to said mold in a direction generally perpendicular to the direction in which the melt is poured.

In yet another embodiment of said first aspect, the alloy is an aluminum alloy which contains 0.001–0.01% B and 0.005–0.30% Ti.

According to the second aspect of the invention, the melt of a hypo-eutectic aluminum alloy having a composition at or above maximum solubility limits is cast into a billet-forming mold with care being taken to insure that the temperature of the melt as it is poured into said mold exceeds the liquidus line of the alloy, but is not higher by more than 30° C. and said melt is cooled to solidify within said mold at a cooling rate of at least 1.0° C./sec over the solidification zone so as to form a billet and, subsequently, said billet is heated to a temperature above the eutectic point of said alloy and the holding time and temperature are selected in such a way that the liquid-phase content of the billet is adjusted to between 20% and 80% and that the primary crystals are spheroidized and, thereafter, the semi-solid billet having the so adjusted liquid-phase content is supplied into a shaping mold and shaped under pressure.

In an embodiment of this second aspect, the aluminum alloy is one which contains 0.001–0.01% B and 0.005–0.30% Ti.

In another embodiment of said second aspect, the aluminum alloy is one which contains 0.001–0.01% B, 0.005–0.30% Ti and 4–6% Si.

In yet another embodiment, the billet-forming mold is supplied with the molten alloy as small vibrations are applied to said mold in a direction generally perpendicular to the direction in which the melt is poured.

The second object of the invention can be attained in accordance with the third aspect of the invention. According to the third aspect, the melt of a magnesium or an aluminum alloy that is held to exceed the liquidus line of the alloy, but not higher by more than 30° C. is cast in a billet-forming mold at a cooling rate of at least 1.0° C./sec over the solidification zone so as to form a billet of a structure comprising fine, equiaxed crystal grains.

In an embodiment of this third aspect, the alloy is a magnesium alloy which contains 5–10% Al, 0.1–3.1% Zn and 0.1–0.6% Mn.

In another embodiment of said third aspect, the alloy is a magnesium alloy which contains 5–12% Al and 0.1–0.6% Mn.

In yet another embodiment of said third aspect, the alloy is an aluminum alloy which contains 0.001–0.01% B and 0.005–0.30% Ti.

In the fourth embodiment of said third aspect, the alloy is an aluminum alloy which contains 0.001–0.01% B, 0.005–0.30% Ti and 4–6% Si.

In the fifth embodiment of the third aspect, the billet-forming mold is supplied with the molten alloy as small vibrations are applied to said mold in a direction generally perpendicular to the direction in which the melt is poured.

DETAILED DESCRIPTION OF THE INVENTION

Figure 1:
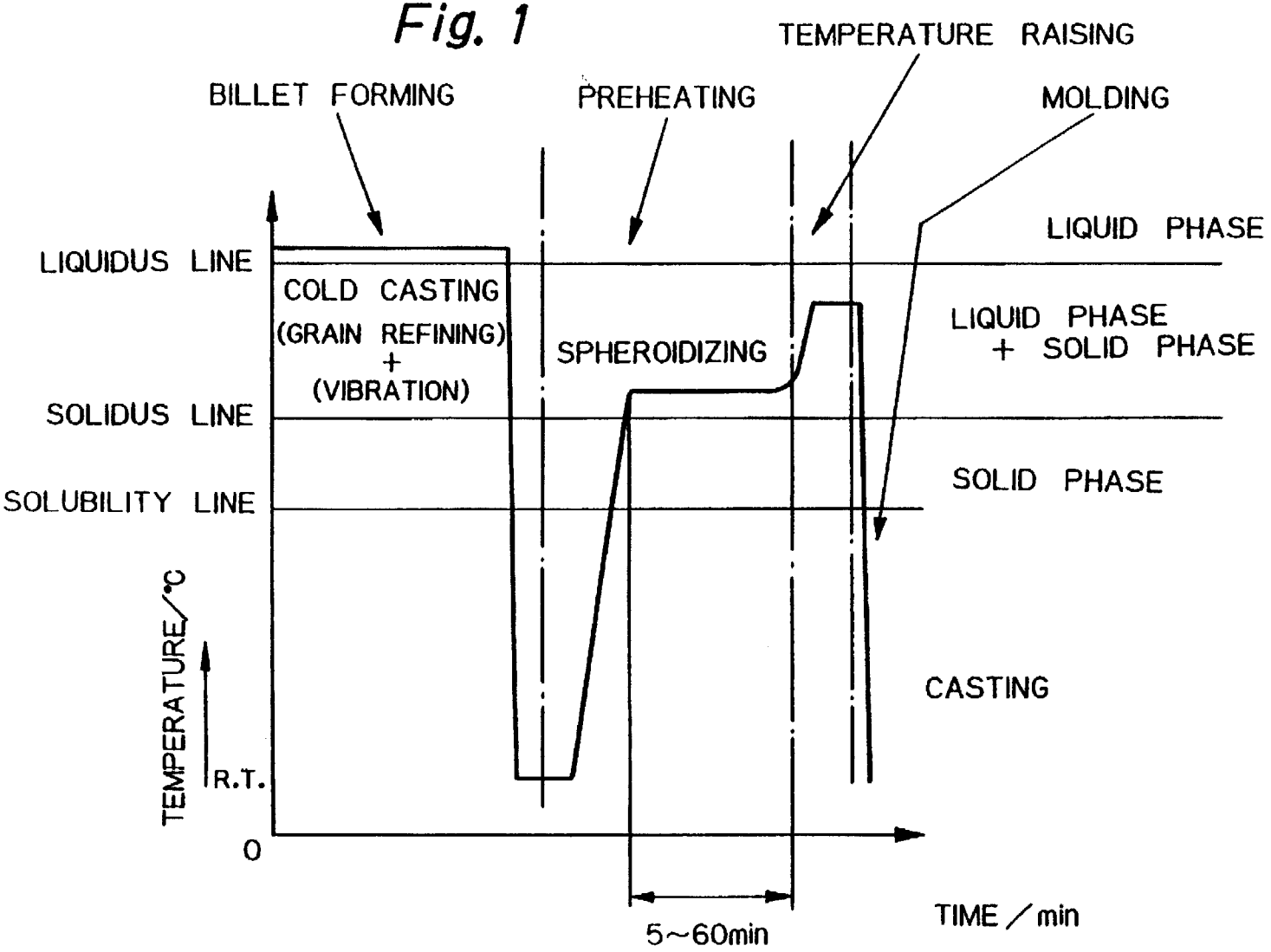
FIG. 1 is a flowsheet for the semi-solid metal processing method of the invention that was implemented in Example 1 on a magnesium and an aluminum alloy that had compositions within maximum solubility limits.

The semi-solid metal processing method of the invention may start from (1) a magnesium or aluminum alloy that has a composition within maximum solubility limits or (2) an aluminum alloy having a composition at or above maximum solubility limits. If either type of alloys is melted at a temperature exceeding the liquidus line, but not higher by more than 30° C. and if it is thereafter cast at a cooling rate of at least 1.0° C./sec over the solidification zone, one can produce billets comprising fine, equiaxed crystals.

It has been confirmed by experimental data that the cooling rate in the solidification zone can be as fast as about 500° C./sec and that the size of crystal grains decreases with the increasing cooling rate; however, if the rapidly cooled billet is reheated, the coarsening of the spheroidal primary crystals is also rapid. Hence from a practical viewpoint, the cooling rate should not exceed about 100° C./sec and the preferred range is from 5° to 10° C./sec.

The billet from the alloy of type (1) is heated from the solubility line to the solidus line of the alloy at a rate of at least 0.5° C./min and, thereafter, it is heated to a semi-solid temperature range above the solidus line and held in that temperature range for 5–60 minutes, whereby the primary crystals are readily spheroidized and a part of a homogeneous structure can be shaped by forming under pressure.

As regards the rate of heating from the solubility line to the solidus line, there is no particular reason to set the upper limit and, hence, the heating rate is theoretically unlimited in an upward direction, except by the technical means such as heating means that are available in the state of the art; hence, the practical upper limit of the heating rate is from about 50° to about 100° C./min. The billet from the alloy of type (2) is heated to a temperature above the eutectic point and the holding time and temperature are selected appropriately to adjust the liquid-phase content to between 20% and 80% so that the primary crystals are spheroidized and subsequent forming yields a shaped part of a homogeneous structure.

The invention will now be described specifically and in detail with reference to the accompanying drawings.

Figure 3:
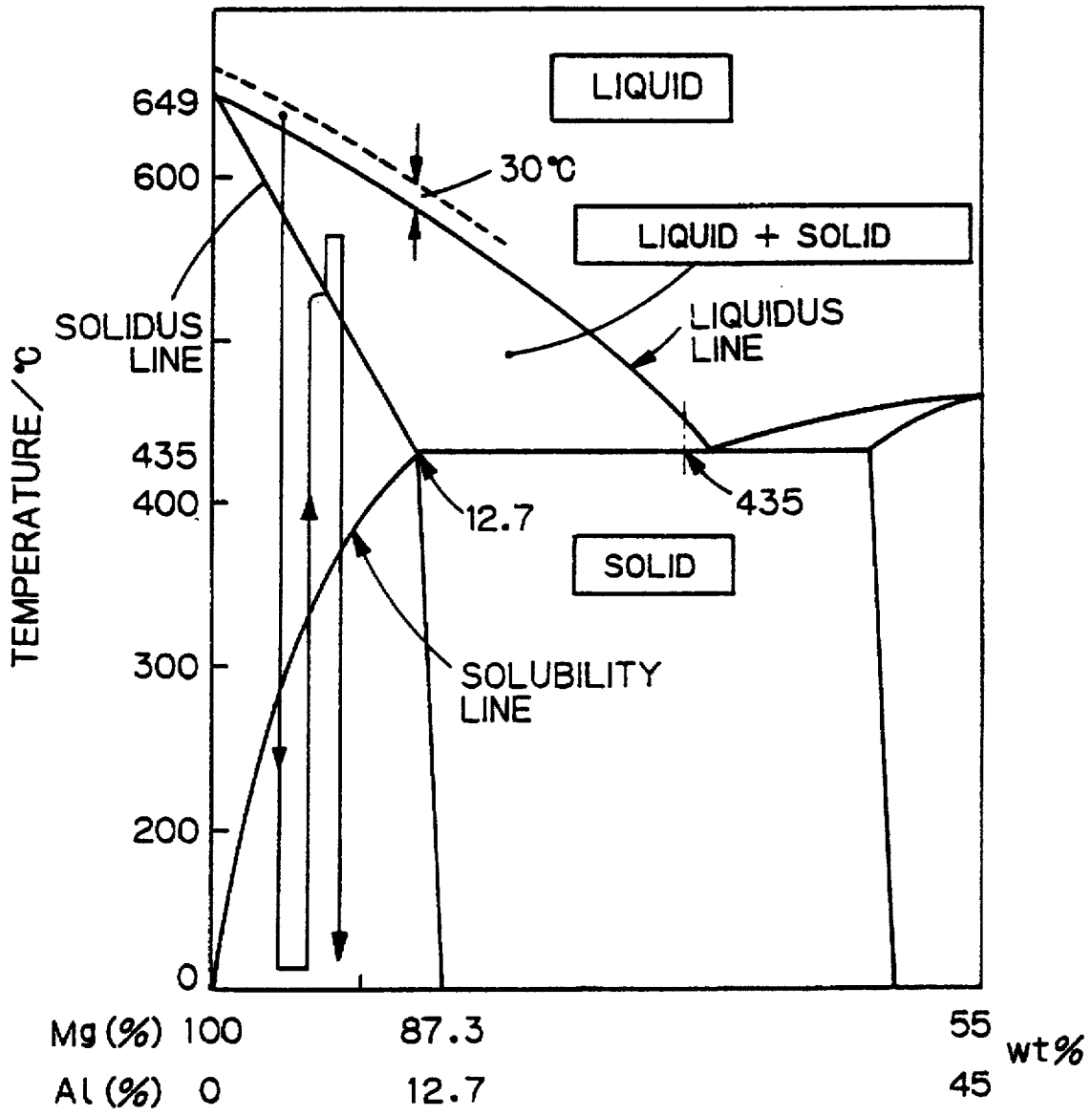
FIG. 3 is the phase diagram of representative magnesium alloys used in Example 1.
Figure 4:
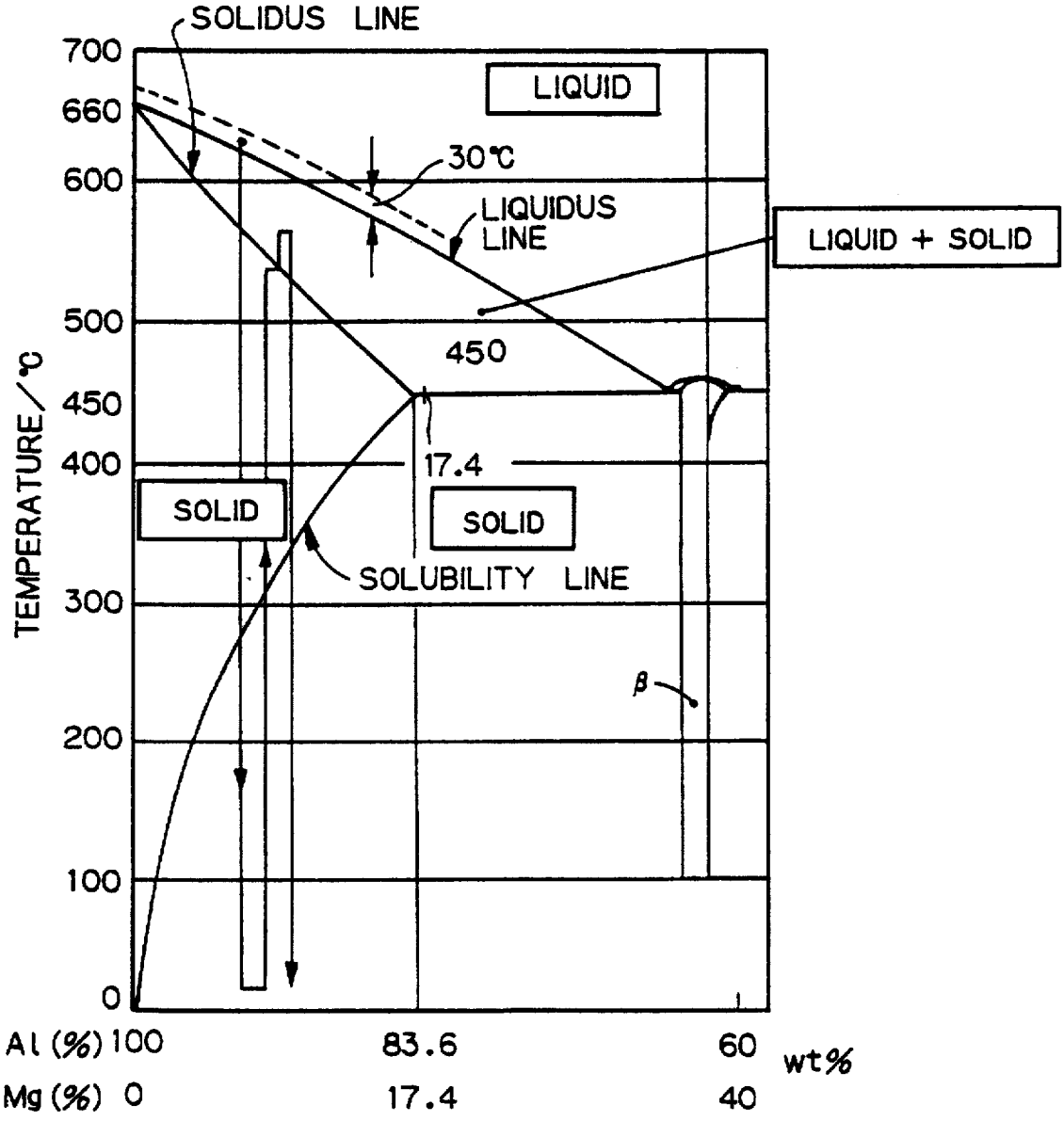
FIG. 4 is the phase diagram of representative aluminum alloys used in Example 1.

The invention is first described for the case where the forming method is applied to a magnesium or aluminum alloy that have a composition within maximum solubility limits (which are hereunder referred to as "light metal"). As depicted in FIGS. 1, 3 and 4, the light metal is poured gently into a billet-forming mold as it is kept at a temperature above the liquidus line, but not exceeding it by more than 30° C. The melt in the mold is so controlled that it is cooled at a rate of at least 1.0° C./sec. As a result of this controlled cooling to room temperature, the melt solidifies to form a billet, which is heated again from room temperature. This heating process comprises heating the billet at a rate of 0.5° C./min or more within the region from the solubility line to the solidus line (the triangular area as bound by these two lines and the temperature axis of each phase diagram), followed by heating further to a temperature above the solidus line, and holding at this temperature for 5–60 minutes, whereby the primary crystals in the metal structure of the alloy become spheroidal.

In the next step, the billet is further heated to a molding temperature below the liquidus line and the semi-solid billet is fed into a shaping mold and quenched rapidly under pressure to form a shaped part.

Figure 7:
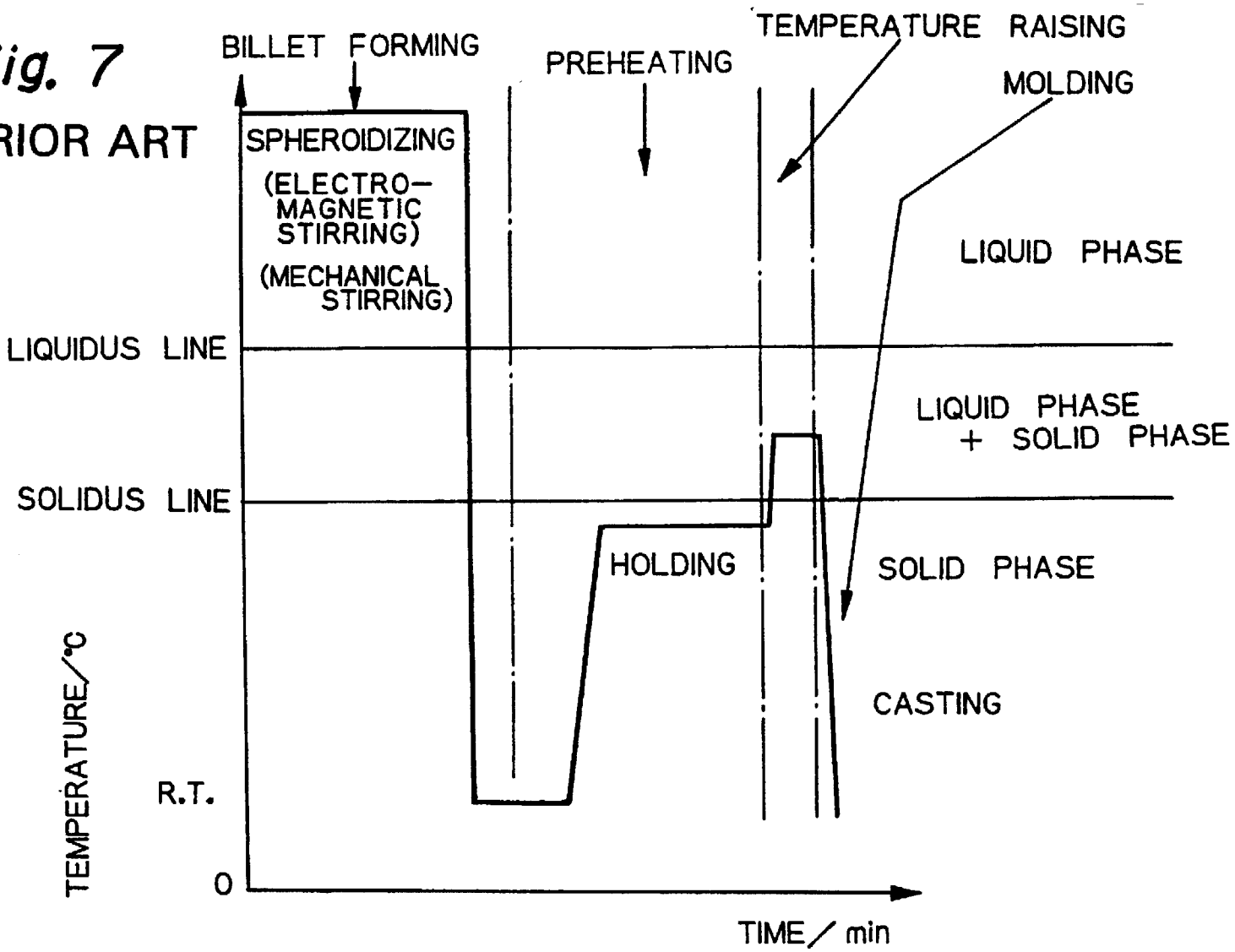
Fig. 7 PRIOR ART
FIG. 7 is a flowsheet for the shaping process by a conventional thixotropic casting method.

A flowsheet for the conventional thixotropic casting method is shown in FIG. 7 and one can see the differences from the forming method of the invention by comparing it with FIG. 1.

If an appropriate liquid-phase content is attained at the spheroidizing temperature, the semi-solid billet may immediately be shaped at this temperature without further heating.

Figure 8:
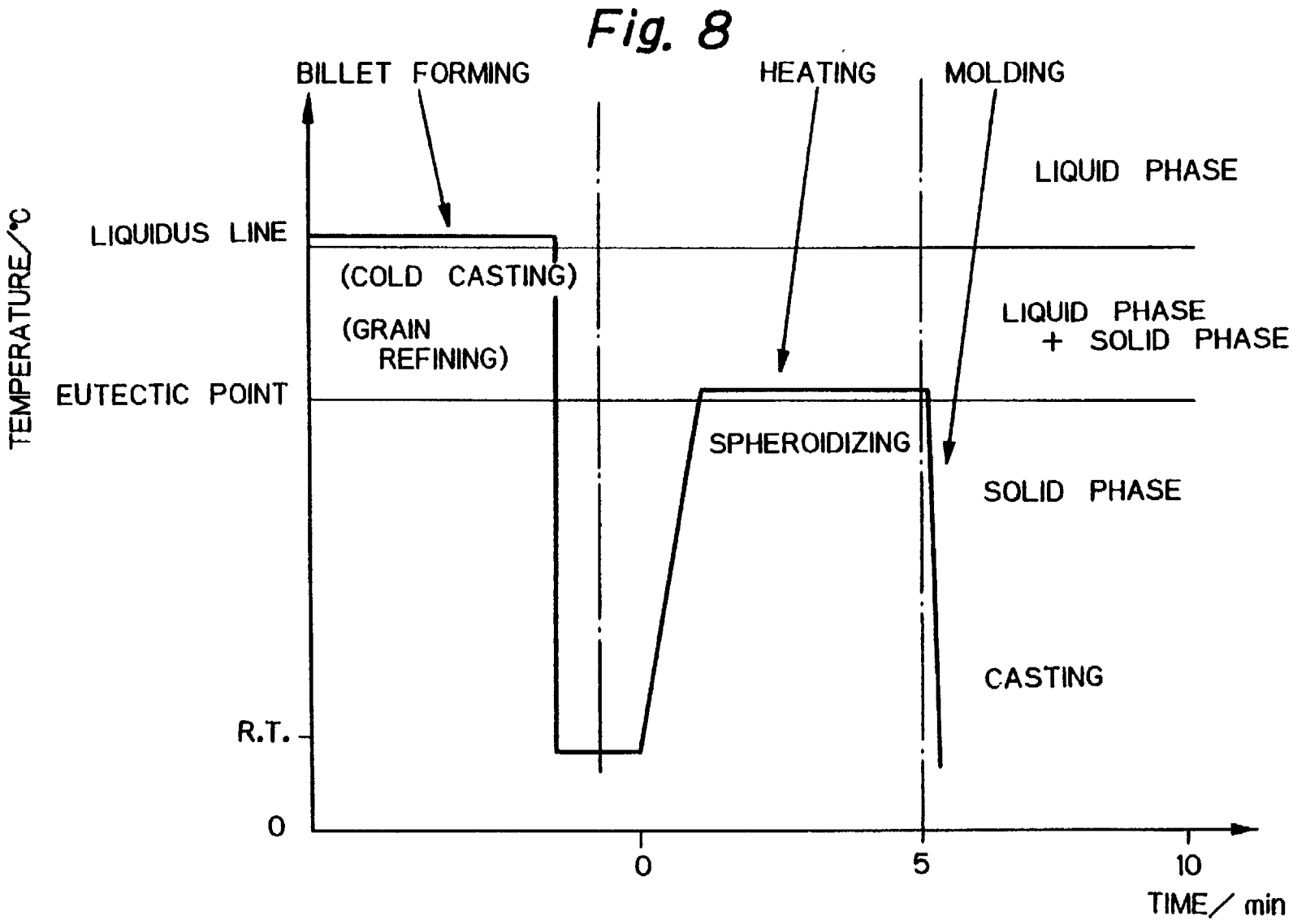
FIG. 8 is a flowsheet for the semi-solid metal processing method of the invention that was implemented in Example 2 on hypo-eutectic aluminum alloys that had compositions at or above maximum solubility limits.
Figure 9:
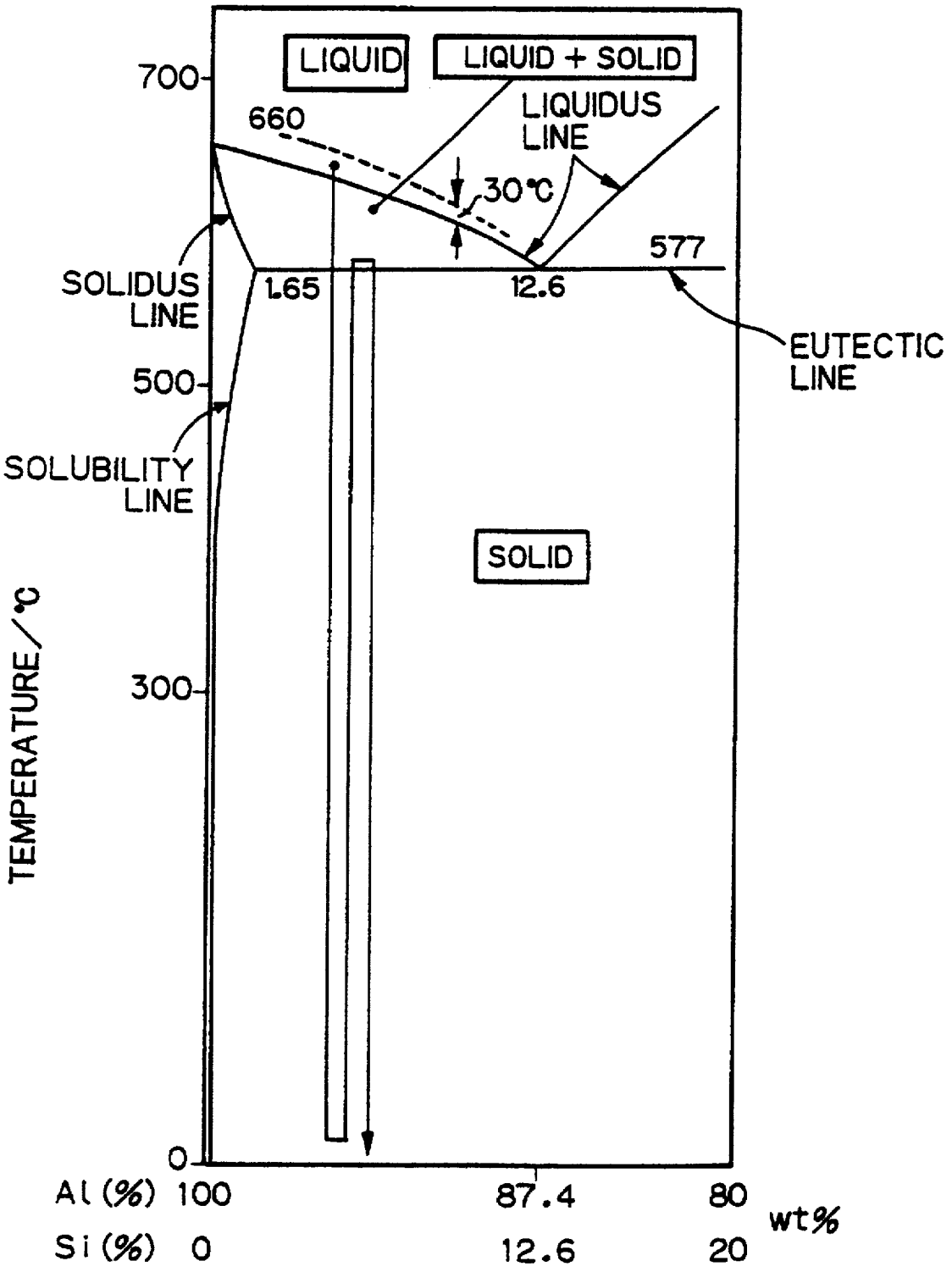
FIG. 9 is the phase diagram of representative aluminum alloys that were used in Example 2.
Figure 10:
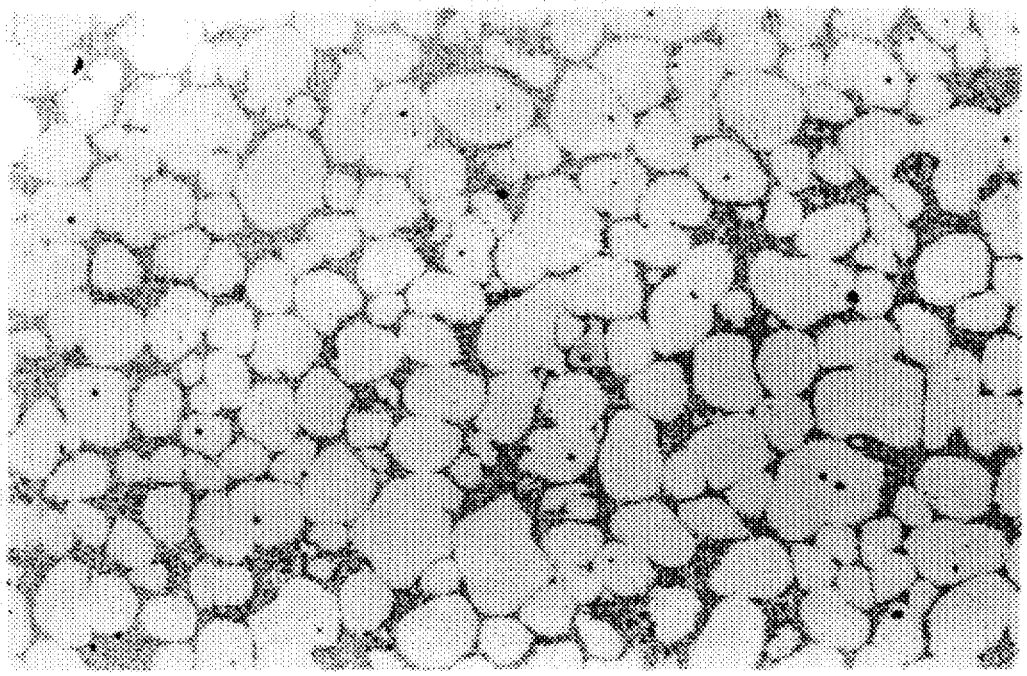
FIG. 10 is a micrograph showing the metal structure of one of the shaped parts produced in Example 2.

FIGS. 8–10 relate to the case where the method of the invention is implemented using a hypo-eutectic aluminum alloy having a composition at or above maximum solubility limits. As depicted in FIGS. 8 and 9, the starting hypo-eutectic aluminum alloy is poured gently into a billet-forming mold as it is kept at a temperature above the liquidus line, but not exceeding it by more than 30° C. The melt in the mold is so controlled that it is cooled at a rate of at least 1.0° C./sec.

Figure 12:
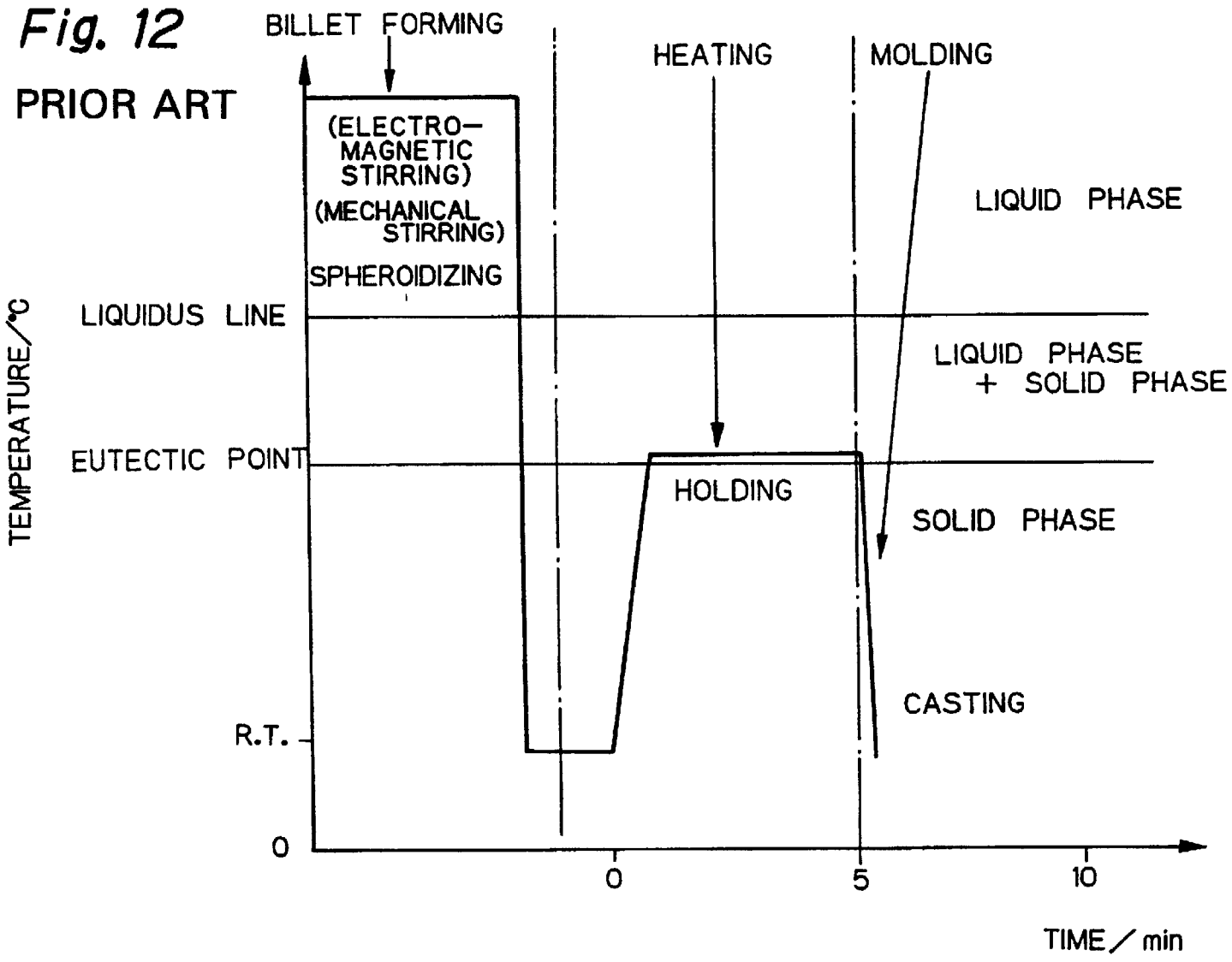
Fig. 12 PRIOR ART
FIG. 12 is a flowsheet for the conventional forming method.

As a result of this controlled cooling to room temperature, the melt solidifies to form a billet, which is then heated to a temperature above the eutectic point and the holding time and temperature are selected appropriately to adjust the liquid-phase content to between 20% and 80% so that the primary crystals are spheroidized. Subsequently, the semi-solid billet is formed under pressure to a shape. The differences between the method of the invention and a prior art thixoforming process are apparent from the comparison between FIGS. 8 and 12. According to the method of the invention shown in FIG. 8, a billet having a metal structure characterized by fine crystal grains is formed and then heated to a temperature above the eutectic point and held for a specified time to generate a specified amount of liquid phase and the characteristics of said metal structure are exploited to cause rapid spheroidizing of the primary crystals and, thereafter, the billet is subjected to semi-solid forming. In the prior art thixoforming, the billet already has spheroidal primary crystals and, after being heated to a temperature above the eutectic point, the billet is held at that temperature for a specified time to generate a liquid phase and, thereafter, the billet is subjected to semi-solid forming. In other words, the billet is held at a temperature above the eutectic point in the invention not merely for generating a liquid phase, but also for spheroidizing the primary crystals.

We will now discuss the steps of billet forming, preheating, reheating and molding shown in FIGS. 1 and 8, particularly with respect to the conditions of casting, reheating and spheroidizing, as well as the criticality of the compositions of the magnesium and aluminum alloys that can advantageously be used in the practice of the invention.

Discussion is first made with reference to FIG. 1. If the casting temperature is higher than the melting point by more than 30° C. or if the rate of cooling in the solidification zone is less than 1.0° C./sec, satisfactorily fine, equiaxed crystals are not obtainable even if grain refining agents are contained. To avoid this problem, the casting temperature is set to be higher than the liquidus line by 30° C. or less and the rate of cooling in the solidification zone is set to be at least 1.0° C./sec. If temperature is raised from the solubility line to the solidus line at a rate of less than 0.5° C./min, the nonequilibrium phase formed as a result of nonequilibrium solidification will dissolve to create a solid solution and will melt only with difficulty when the temperature exceeds the solidus line. To avoid this problem, the billet is heated from the solubility line to the solidus line at a rate of 0.5° C./min or above. If the holding time at a temperature exceeding the solidus line is less than 5 minutes, the primary crystals will become spheroidal only insufficiently; even if the holding time exceeds 60 minutes, the spheroidizing effect is saturated and the grains will become coarse rather fine. To avoid this problem, the holding time in the semi-solid temperature range exceeding the solidus line shall be 5–60 minutes.

In the case of using Sr-containing magnesium alloys, if the Sr content is less than 0.005%, its grain refining effect is small and even if Sr is added in amounts exceeding 0.1%, its refining effect is saturated. Therefore, the Sr content is set between 0.005% and 0.1%. Finer grains will result if this addition of Sr is supplemented by 0.01–1.5% Si. If the Si content is less than 0.01%, its grain refining effect is small and if the Si content exceeds 1.5%, $Mg_2Si$ will be produced in the primary grains, causing deterioration in mechanical properties.

In the case of using Ca-containing magnesium alloys, if the Ca content is less than 0.05%, the crystal grains will not be refined satisfactorily and even if Ca is added in amounts exceeding 0.3%, its grain refining effect is saturated. Therefore, the Ca content is set between 0.05% and 0.3%.

In the case of using Ti-containing aluminum alloys, if the Ti content is less than 0.005%, its grain refining effect is small and if the Ti content exceeds 0.30%, coarse Ti compounds will be generated to reduce the ductility of the billet. Therefore, the Ti content is set between 0.005% and 0.30%.

Boron, when present in combination with Ti, will promote grain refining; however, if the B content is less than 0.001%, the crystal grains will not be refined and even if the B content exceeds 0.01%, its grain refining effect is saturated. Therefore, the B content is set between 0.001% and 0.01%.

Discussion will now be made with reference to FIG. 8. If the casting temperature is higher than the melting point by more than 30° C. or if the rate of cooling in the solidification zone is less than 1.0° C./sec, fine equiaxed crystals are not obtainable even if grain refining agents are contained. To avoid this problem, the casting temperature is set to be higher than the liquidus line by 30° C. or less and the rate of cooling in the solidification zone is set to be at least 1.0° C./sec. If the liquid-phase content is less than 20%, the spheroidization of the primary crystals will not proceed smoothly and, due to high resistance to deformation, forming under pressure is not easy to accomplish and one cannot produce shaped parts of good appearance. If the liquid-phase content exceeds 80%, the billet is unable to maintain the initial shape fully or one cannot produce shaped parts of a homogeneous structure. To avoid these problems, the liquid-phase content in the semi-solid temperature range above the eutectic point is set between 20% and 80%.

Stated more specifically, alloys having such a composition that the liquid-phase content at the eutectic point is less than 20% are heated for a specified time in the temperature range higher than the eutectic point; alloys having such a composition that the liquid-phase content at the eutectic points is 20–80% are heated for a specified time at the eutectic point or higher temperatures; alloys having such a composition that the liquid-phase content at the eutectic point exceeds 80% but is less than 100% are heated for a specified time at the eutectic point; by either method of treatment, the effective liquid-phase content is adjusted to lie between 20% and 80% so that the primary crystals become spheroidal and, thereafter, the semi-solid billet is fed into a shaping mold and formed to a shape under pressure.

More preferably, the effective liquid-phase content is adjusted to lie between 30% and 70% because this provides ease in producing a more homogeneous shaped part.

Crystal grains are refined by reducing the casting temperature but even finer grains can be produced by adding Ti and B to aluminum alloys. If the addition of Ti is less than 0.005%, its grain refining effect is small and if the Ti addition exceeds 0.30%, coarse Ti compounds will be generated to reduce the ductility of the billet. Therefore, the Ti addition is set between 0.005% and 0.30%. Boron, when added in combination with Ti, will promote grain refining; however, if the B addition is less than 0.001%, the crystal grains will not be refined and even if the B addition exceeds 0.01%, its grain refining effect is saturated. Therefore, the B addition is set between 0.001% and 0.01%. If the Si content in Si-containing Al alloys is less than 6%, the primary crystals look like petals of a flower and, hence, they will readily become spheroidal if the billet is held in the semi-solid temperature range. However, the strength of the billet is insufficient if the Si content is less than 4%. Therefore, the Si content is set between 4% and 6%.

In yet another embodiment, small vibrations of such magnitudes as an acceleration of ca. 1–200 gal and an amplitude of ca. 1 μm–10 mm are applied to a billet-forming mold in a direction generally perpendicular to the direction in which the melt is being poured into the mold. Such small vibrations may be applied by any method such as pneumatic or electromagnetic means. It is preferred to apply such small vibrations to the melt being poured into the mold since it contributes to the making of a billet comprising even finer crystal grains.

The following examples are provided for the purpose of further illustrating the invention but are in no way to be taken as limiting.

EXAMPLE 1

Figure 2:
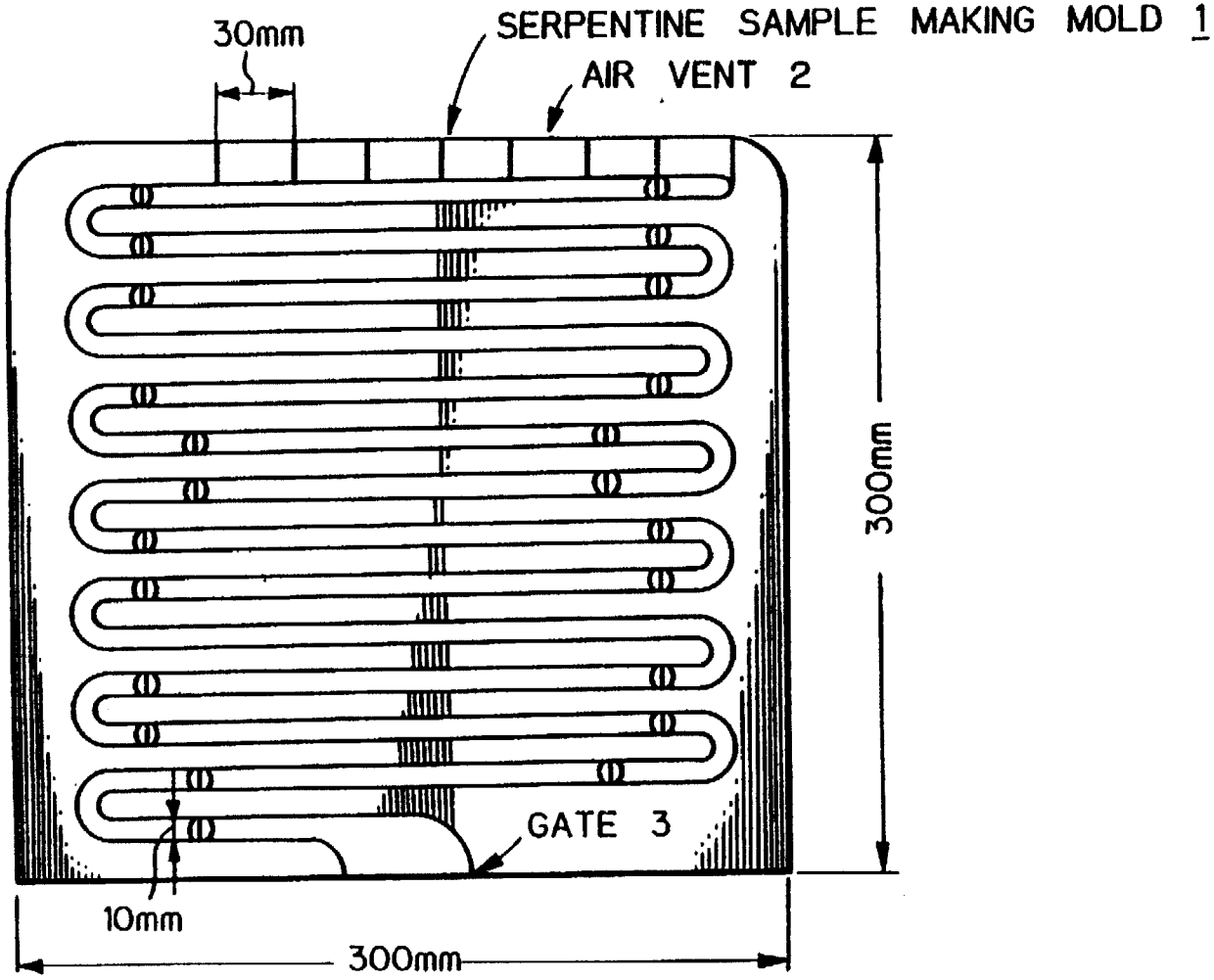
FIG. 2 is a front view of the serpentine sample making mold that was used in Example 1.

FIG. 2 is a front view of a serpentine sample making mold for sampling test specimens. The melt is injected into the mold 1 through a gate 3 and the internally evolved gas is discharged through air vents 2. Samples of an aluminum and a magnesium alloy having compositions within maximum solubility limits (see Table 1) were formed in accordance with the invention using the mold 1. Comparison data for various test specimens of the samples are also given in Table 1. The billets were cooled at rates generally in the range from 5° to 10° C./sec. The experiment in Example 1 was conducted on the assumption that the respective alloys had the following liquidus line temperatures (LIT).

| Alloy | LIT |
|---|---|
| MC 2 | 595° C. |
| AC7A | 635° C. |

TABLE 1

| Sample No. | Alloy | Casting temperature (°C.) | Vibrations | Reheating rate (°C./min) | Spheroidizing (°C. × min) | Homogeneity of shaped part |
|---|---|---|---|---|---|---|
| Invention | | | | | | |
| 1 | MC2 | 620 | — | 50 | 560 × 20 | good |
| 2 | MC2 | 620 | — | 5 | 550 × 30 | good |
| 3 | MC2 (0.3%Si, 0.02%Sr) | 623 | — | 5 | 560 × 30 | good |
| 4 | MC2 (0.2%Ca) | 623 | — | 5 | 560 × 30 | good |
| 5 | MC2 (0.02%Sr) | 623 | — | 5 | 560 × 30 | good |
| 6 | AC7A | 655 | — | 5 | 580 × 30 | good |
| 7 | AC7A (0.18%Ti, 0.005%B) | 655 | — | 5 | 585 × 20 | good |
| 8 | MC2 | 623 | applied | 5 | 550 × 60 | good |
| Comparison | | | | | | |
| 9 | MC2 | 620 | — | 0.3 | 565 × 20 | poor |
| 10 | MC2 | 680 | — | 5 | 565 × 20 | poor |
| 11 | MC2 | 620 | — | 5 | 560 × 1 | poor |
| 12 | MC2 | 620 | — | 5 | 560 × 120 | poor |

(Note)
MC2; Mg—9%Al—0.8%Zn
AC7A; Al—5.0%Mg—0.4%Mn

Figure 5:
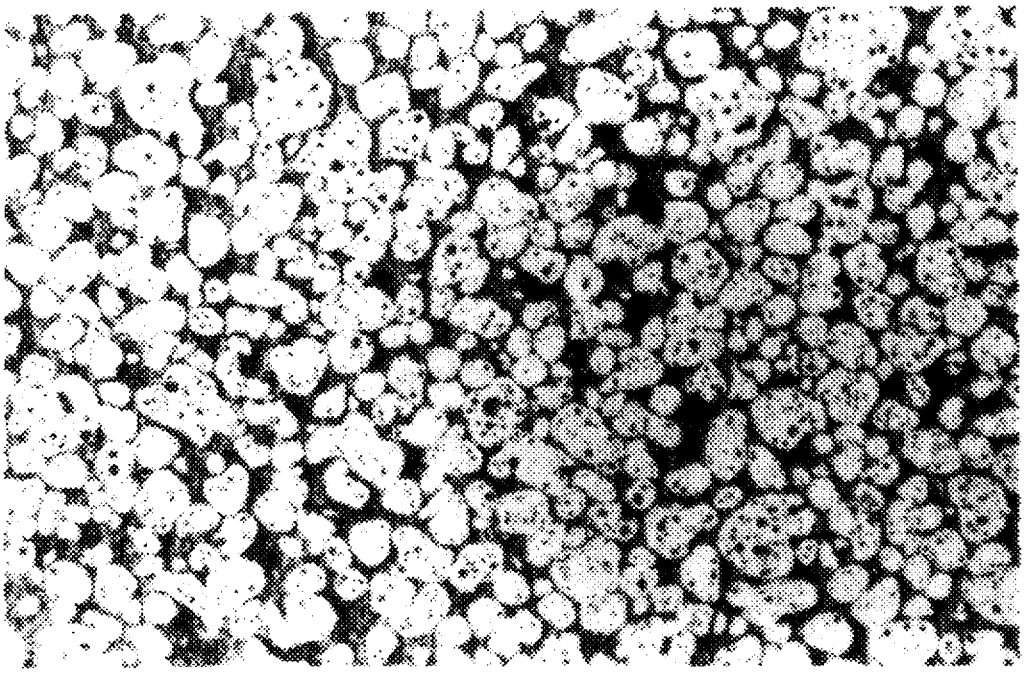
FIG. 5 is a micrograph showing the metal structure of one of the shaped parts produced in Example 1.
Figure 6:
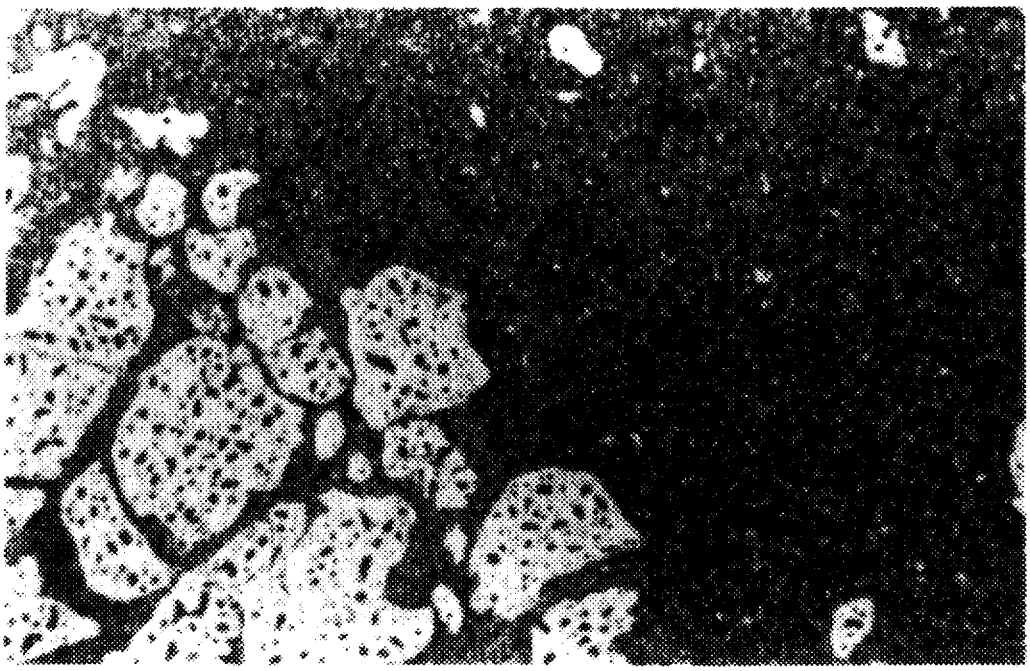
Fig. 6 PRIOR ART
FIG. 6 is a micrograph showing the metal structure for comparison which was the shaped part produced by a conventional forming process.

Table 1 shows that the homogeneity of shaped alloy parts differed significantly with various factors such as the casting temperature, the application of small vibrations, the reheating rate and the spheroidizing conditions (temperature and time); obviously, the samples of the invention (Nos. 1–8) were superior to the prior art samples (Nos. 9–12). As FIG. 5 shows typically, the samples of the invention had a uniform and fine-grained structure; on the other hand, as FIG. 6 shows, the prior art samples had such a structure that only the primary crystals which composed the solid phase remained at the gate whereas the preferential flow of the liquid phase to the serpentine path was indicated by the high proportion of a eutectic structure. Thus, the prior art samples as shaped parts had different structures than the initial structures of the alloys. The following is a more specific description: prior art sample No. 9 which was reheated at a rate of less than 0.5° C./min let the eutectic crystals in the as-cast material form a solid solution and, as a result, the spheroidizing rate slowed down making it difficult to produce a fully spheroidized structure; prior art sample No. 10 which was cast at a temperature more than 30° C. above the liquidus line comprised large crystal grains and, hence, the structure that could be obtained was no more than what contained a high proportion of coarse grains of indefinite shapes; prior art sample No. 11 did not have a fully spheroidized structure due to unduly short holding time (<5 minutes); prior art sample No. 12 comprised a coarse spheroidal structure due to excessively long holding time (>60 minutes). These would be the reasons explaining the structure shown in FIG. 6. In contrast, the samples of the invention which were cast at low temperatures that were above the liquidus line, but not higher by more than 30° C. each had a structure consisting of fine, equiaxed crystals. Even finer, equiaxed grain structures could be produced when Sr was solely added (sample No. 5), or both Si and Sr were added (sample No. 3) or Ca was added (sample No. 4) to the magnesium alloy, or when both Si and Sr were added to the aluminum alloy (sample No. 7), or when small vibrations were applied during casting (sample No. 8). The castings having these structures are characterized by efficient progress of spheroidization and, hence, can be thixoformed to produce shaped parts of a homogeneous structure.

EXAMPLE 2

Samples of aluminum alloys having compositions at or above maximum solubility limits (see Table 2) were formed in accordance with the invention using the serpentine sample making mold 1. Comparison data for various test specimens of the samples are also given in Table 2. The billets were cooled at rates generally in the range from to 10° C./sec. The experiment in Example 2 was conducted on the assumption that the respective alloys had the following liquidus line temperatures (LIT).

| Alloy | LIT |
|---|---|
| Al—3%Si—0.5%Mg | 641° C. |
| Al—5%Si—0.5%Mg | 630° C. |
| Al—7%Si—0.35%Mg | 610° C. |
| Al—9%Si—0.35%Mg | 605° C. |
| Al—11%Si—0.35%Mg | 584° C. |
| Al—7%Si—0.35%Mg—0.15%Ti | 610° C. |
| Al—7%Si—0.35%Mg—0.15%Ti—0.005%B | 610° C. |
| Al—2%Si—0.5%Mg | 648° C. |
| Al—10%Si—0.35%Mg | 598° C. |

TABLE 2

| Sample No. | Alloy | Casting temperature (°C.) | Vibrations | Spheroidizing temperature (°C.) | Liquid-phase content (%) | Homogeneity of shaped part | Appearance of shaped part |
|---|---|---|---|---|---|---|---|
| Invention | | | | | | | |
| 1 | Al—3%Si—0.5%Mg | 658 | — | 610 | 25 | good | good |
| 2 | Al—5%Si—0.5%Mg | 648 | — | 580 | 32 | good | good |
| 3 | Al—7%Si—0.35%Mg | 635 | — | 580 | 50 | good | good |
| 4 | Al—9%Si—0.35%Mg | 621 | — | 580 | 69 | good | good |
| 5 | Al—11%Si—0.35%Mg | 613 | — | 580 | 60 | good | good |
| 6 | Al—7%Si—0.35%Mg—0.15%Ti | 635 | — | 580 | 50 | good | good |
| 7 | Al—7%Si—0.35%Mg—0.15%Ti—0.005%B | 635 | — | 580 | 50 | good | good |
| 8 | Al—7%Si—0.35%Mg—0.15%Ti—0.005%B | 635 | applied | 580 | 50 | good | good |
| Comparison | | | | | | | |
| 9 | Al—2%Si—0.5%Mg | 658 | — | 600 | 9 | poor | poor |
| 10 | Al—3%Si—0.5%Mg | 652 | — | 580 | 13 | poor | poor |
| 11 | Al—10%Si—0.35%Mg | 613 | — | 590 | 87 | poor | good |
| 12 | Al—11%Si—0.35%Mg | 605 | — | 580 | 86 | poor | good |
| 13 | Al—7%Si—0.35%Mg | 720 | — | 580 | 50 | poor | good |
| 14 | Al—5%Si—0.5%Mg | 720 | — | 580 | 32 | poor | good |

Figure 11:
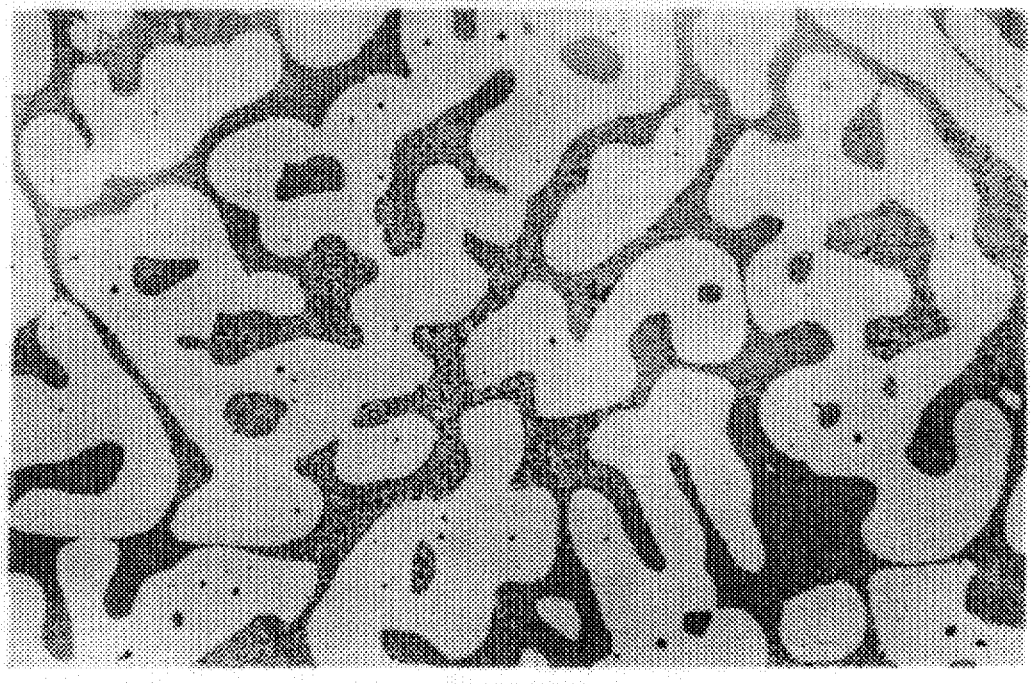
Fig. 11 PRIOR ART
FIG. 11 is a micrograph showing the metal structure for comparison which was the shaped part produced by a conventional forming method.

Table 2 shows that the homogeneity and the appearance of shaped alloy parts differ significantly with various factors such as the casting temperature, the application of small vibrations, the heating temperature (spheroidizing temperature in the case of the invention ) and the liquid-phase content; obviously, the samples of the invention (Nos. 1–8) were superior to the prior art samples (Nos. 9–14) in both the homogeneity and the appearance of shaped parts. As FIG. 10 shows typically, the samples of the invention had a uniform and fine-grained structure compared with the prior art samples typically shown in FIG. 11. Prior art sample Nos. 9 and 10 which had liquid-phase contents smaller than 20% were incapable of efficient progress of the spheroidization of the primary crystals and, hence, the shaped parts had neither a homogeneous structure nor a satisfactory appearance. With prior art sample Nos. 11 and 12 which had liquid-phase contents larger than 80%, the billets were unable to maintain their initial shape during heating and, what is more, the shaped parts did not have structural homogeneity. With prior art sample Nos. 13 and 14 which were cast at temperatures above the liquidus line by more than 30° C., the billets were comprised of unduly large crystal grains and, hence, the primary crystals did not easily produce a spheroidal structure even when the billets were held in the semi-solid temperature range. Because of these reasons, none of the prior art samples had a homogeneous structure.

EXAMPLE 3

The third aspect of the invention as it relates to a process for preparing an aluminum billet suitable for semi-solid metal processing will now be described in detail with reference to FIGS. 13–20.

Figure 13:
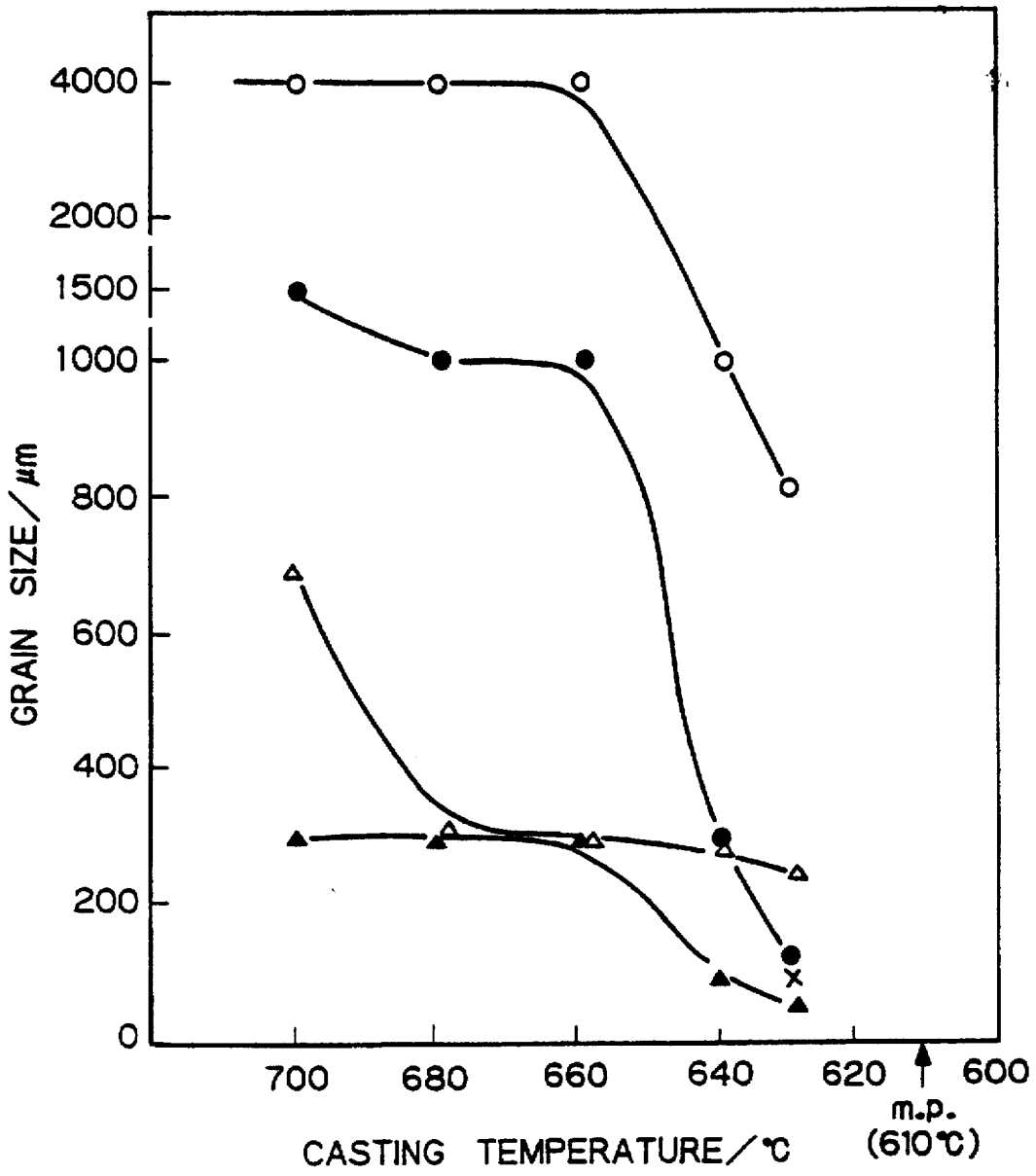
FIG. 13 is a characteristic diagram (graph) showing the correlationship between the crystal grain size and the casting temperature of aluminum alloy (AC4CH) billets that were cast in Example 3.

FIG. 13 is a graph showing the effects of casting temperature on the size of crystal grains in billets of an aluminum alloy AC4CH for two different cooling rates, 6° C./sec and 0.4° C./sec. The billets were cast with a a melt 12 poured from a ladle 13 into a mold 11 of the layout shown in FIG. 14. Obviously, the size of crystal grains in the billets was significantly refined when the casting temperature decreased from 660° C. to 640° C. or when the cooling rate was fast. It should be particularly noted that a structure comprising equiaxed, fine (<100 μm) crystal grains was obtained when Al-5% Ti-1% B was added as a master alloy to AC4CH in an amount of 0.005% on the basis of B.

Figure 15:
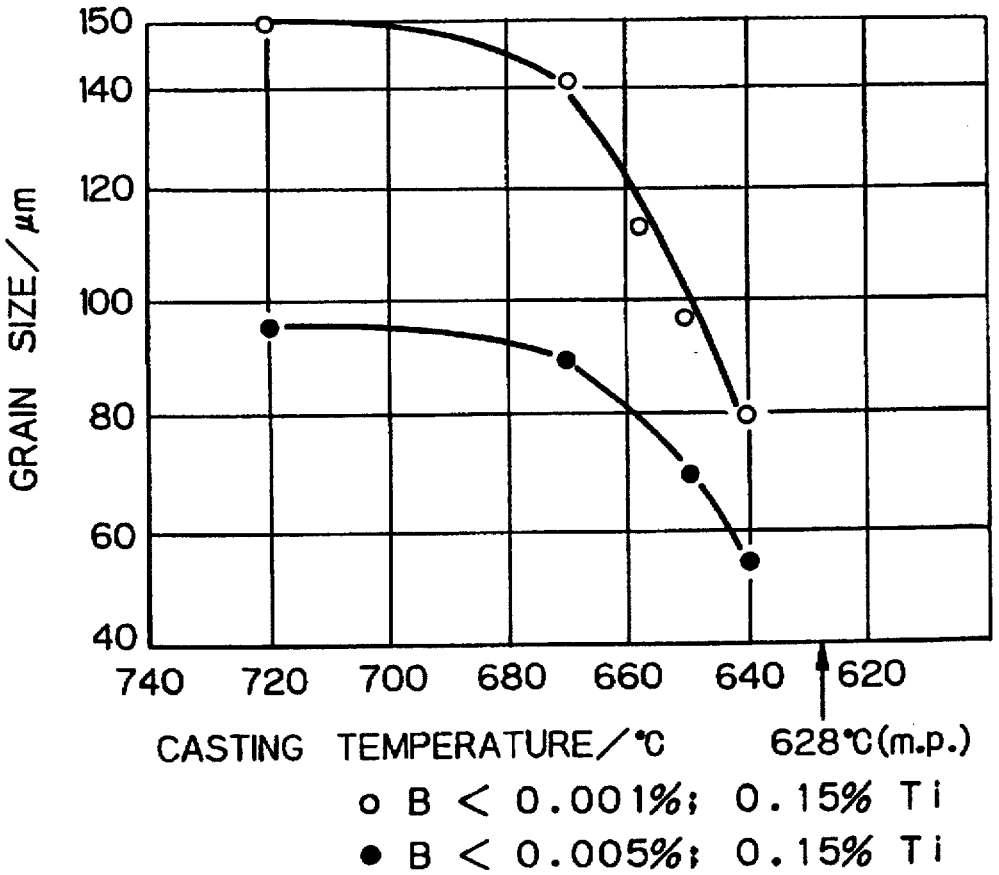
FIG. 15 is a characteristic diagram (graph) showing the correlationship between the crystal grain size and the casting temperature of aluminum alloy (7075) billets that were cast in Example 3.
Figure 16:
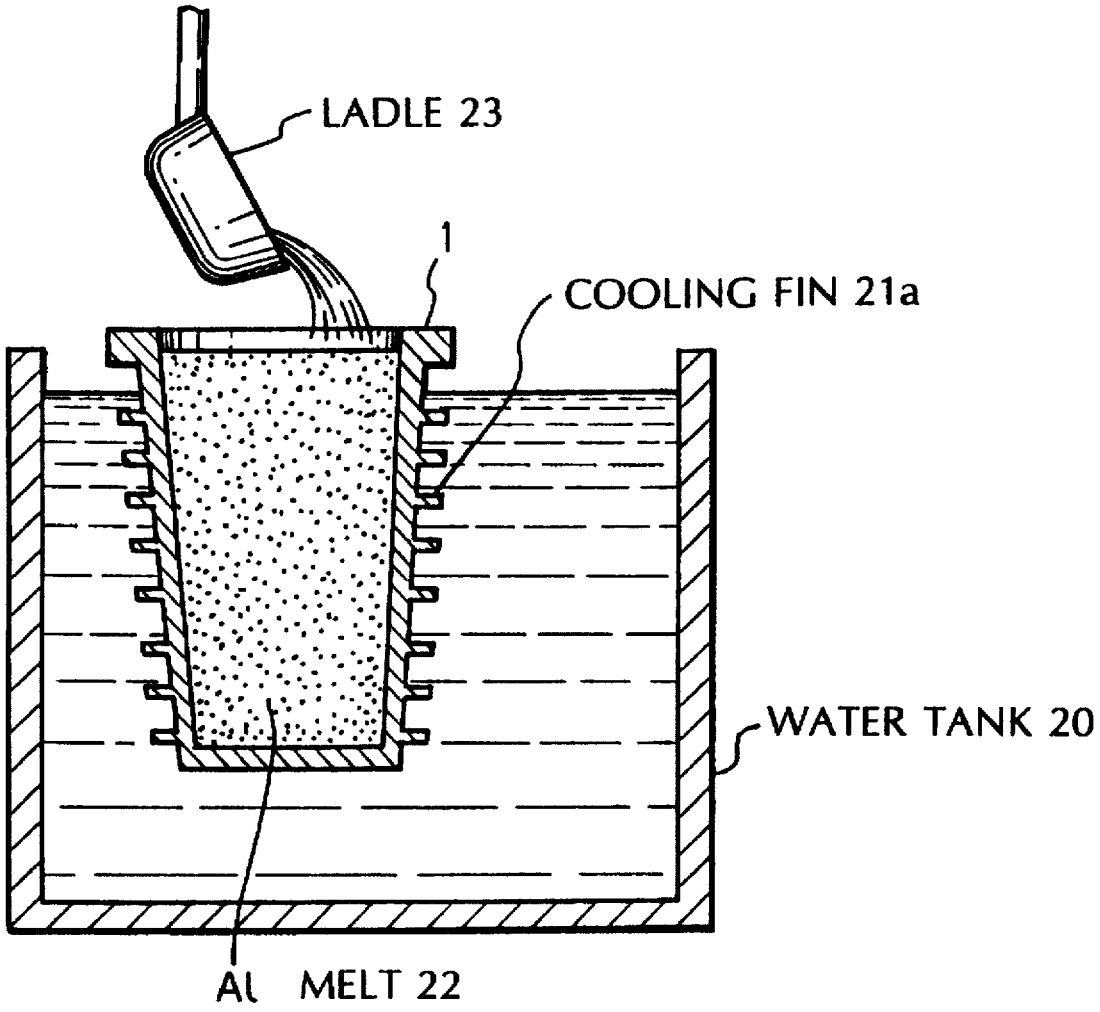
FIG. 16 is a longitudinal section of the mold used in Example 3 to cast the 7075 billets.

FIG. 15 is a graph showing the correlation between the crystal grain size and the casting temperature in the case where an aluminum alloy 7075 melt 22 from ladle 23 was cast in a mold having cooling fins 21*a* submerged in a cold water tank 20 (see FIG. 16), with the billet being cooled at a rate of 10° C./sec. Compared to the billet of AC4CH shown in FIG. 13, the billet of 7075 was comprised of considerably fine crystal grains; however, the effect of the casting temperature on the size of crystal grains in the billets of 7075 was no less significant than in the case of the billet of AC4CH. At casting temperatures that were higher than the melting point of 7075 (628° C.) by 30° C. or less, the crystal grains were much finer than when casting was done at 720° C. This is also true in the case of adding Ti and B as grain refining agents; when the casting temperature was higher than the melting point of 7075 by 30° C. or less, the crystal grains became very fine and they were as fine as about 50 μm at 640° C.

We then discuss the conditions of casting billets from the above-mentioned aluminum alloys, as well as the criticality of the proportions of added elements in those aluminum alloys.

If the casting temperature is higher than the liquidus line by more than 30° C., coarse crystals will result and if the rate of cooling in the solidification zone is less than 1.0° C./sec, coarse crystals will also result even if the casting temperature exceeds the liquidus line by no more than 30° C. or even if Ti and B are added as grain refiners. Therefore, in the present invention, the casting temperature is set to be higher than the liquidus line by no more than 305 whereas the rate of cooling in the solidification zone is set to be at least 1.0° C./sec.

Crystal grains are refined by reducing the casting temperature but even finer grains can be produced by adding Ti and B to aluminum alloys. If the addition of Ti is less than 0.005%, its grain refining effect is small and if the Ti addition exceeds 0.30%, coarse Ti compounds will be generated to reduce the ductility of the billet. Therefore, the Ti addition is set between 0.005% and 0.30%. Boron, when added in combination with Ti, will promote grain refining; however, if the B addition is less than 0.001%, the crystal grains will not be refined and even if the B addition exceeds 0.01%, its grain refining effect is saturated. Therefore, the B addition is set between 0.001% and 0.01%. If the Si content in Si-containing Al alloys is less than 6%, the primary crystals look like petals of a flower and, hence, they will readily become spheroidal if the billet is held in the semi-solid temperature range. However, the strength of the billet is insufficient if the Si content is less than 4%. Therefore, the Si content is set between 4% and 6%.

In a further embodiment of the third aspect of the invention, small vibrations of such magnitudes as an acceleration of ca. 1–200 gal and an amplitude of ca. 1 μm–10 mm are applied to a billet-forming mold in a direction generally perpendicular to the direction in which the melt is being poured into the mold. Such small vibrations may be applied by any method such as pneumatic or electromagnetic means. It is preferred to apply such small vibrations to the melt being poured into the mold since it contributes to the making of a billet comprising even finer crystal grains.

The term "casting temperature" as used herein means the temperature of the melt just prior to pouring into the mold. In the foregoing examples, billets were cast in the mold batchwise, but this is not the sole case of the invention and casting may be performed on a continuous basis.

Figure 17:
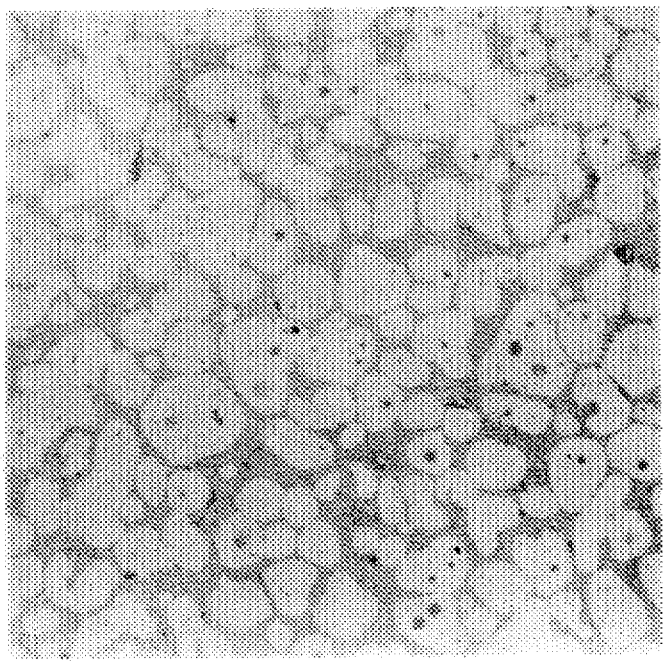
FIG. 17 is a micrograph showing the metal structure of one of the semi-solid formed parts of AC4CH that were produced in Example 3.
Figure 18:
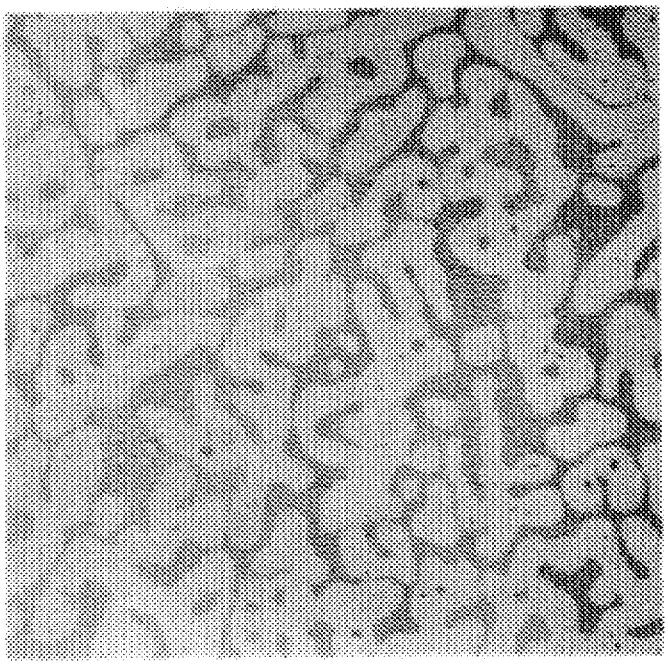
FIG. 18 is a micrograph showing the metal structure of one of the semi-solid formed parts of 7075 that were produced in Example 3.

FIG. 17 is a micrograph showing the metal structure of one of the semi-solid formed parts of AC4CH that were produced in Example 3. Compared to the semi-solid formed part produced by the prior art which had such a metal structure that the crystal grains were not equiaxed, but indefinite in shape as shown by a micrograph in FIG. 18, the shaped part shown in FIG. 17 is characterized by a homogeneous, fine-grained spheroidal structure.

Figure 19:
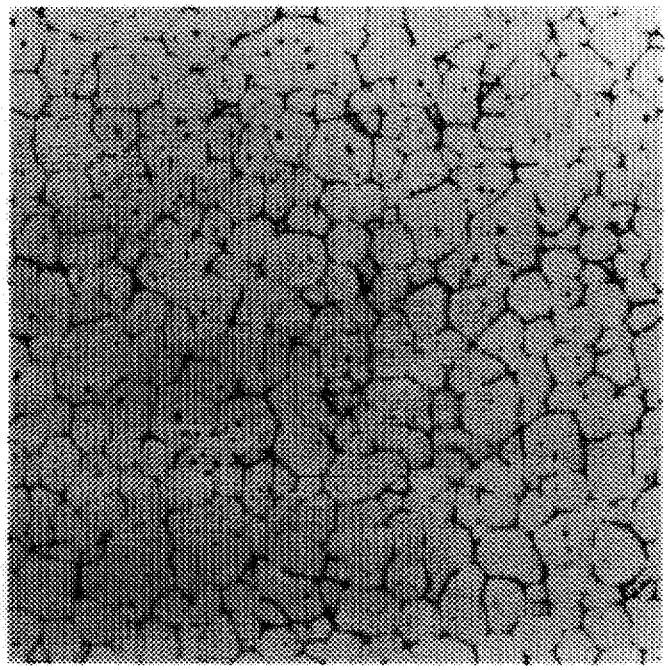
Fig. 19 PRIOR ART
FIG. 19 is a micrograph showing the metal structure of a conventional semi-solid formed part of AC4CH.
Figure 20:
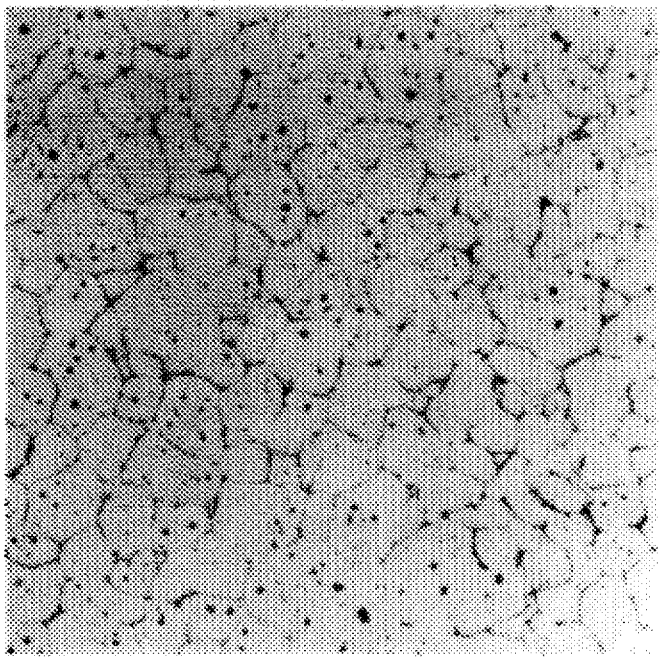
Fig. 20 PRIOR ART
FIG. 20 is a micrograph showing the metal structure of a conventional semi-solid formed part of 7075.

FIG. 19 is a micrograph showing the metal structure of one of the semi-solid formed parts of 7075 that were produced in Example 3, whereas FIG. 20 shows the metal structure of the semi-solid formed part as produced by the prior art. Obviously, the metal structure shown in FIG. 19 is characterized by the homogeneity and of much finer grains.

EXAMPLE 4

The third aspect of the invention as it relates to a process for preparing an alloy billet suitable for use in semi-solid metal processing will now be described with reference to FIGS. 21 and 22. In Example 4, billets were cast from magnesium alloys.

Figure 14:
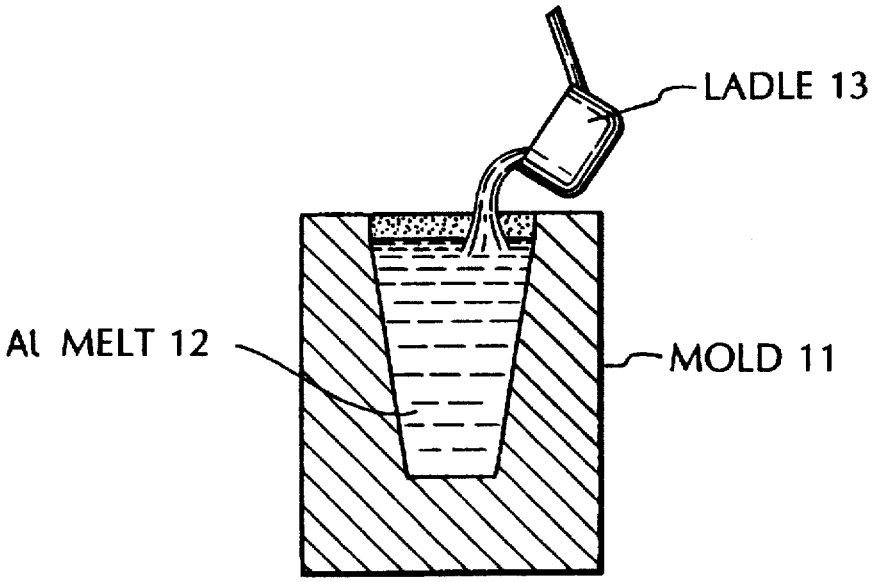
FIG. 14 is a longitudinal section of the mold used in Example 3 to cast the AC4CH billets and in Example 4 to cast magnesium alloy (AZ91 and AM60) billets.
Figure 21:
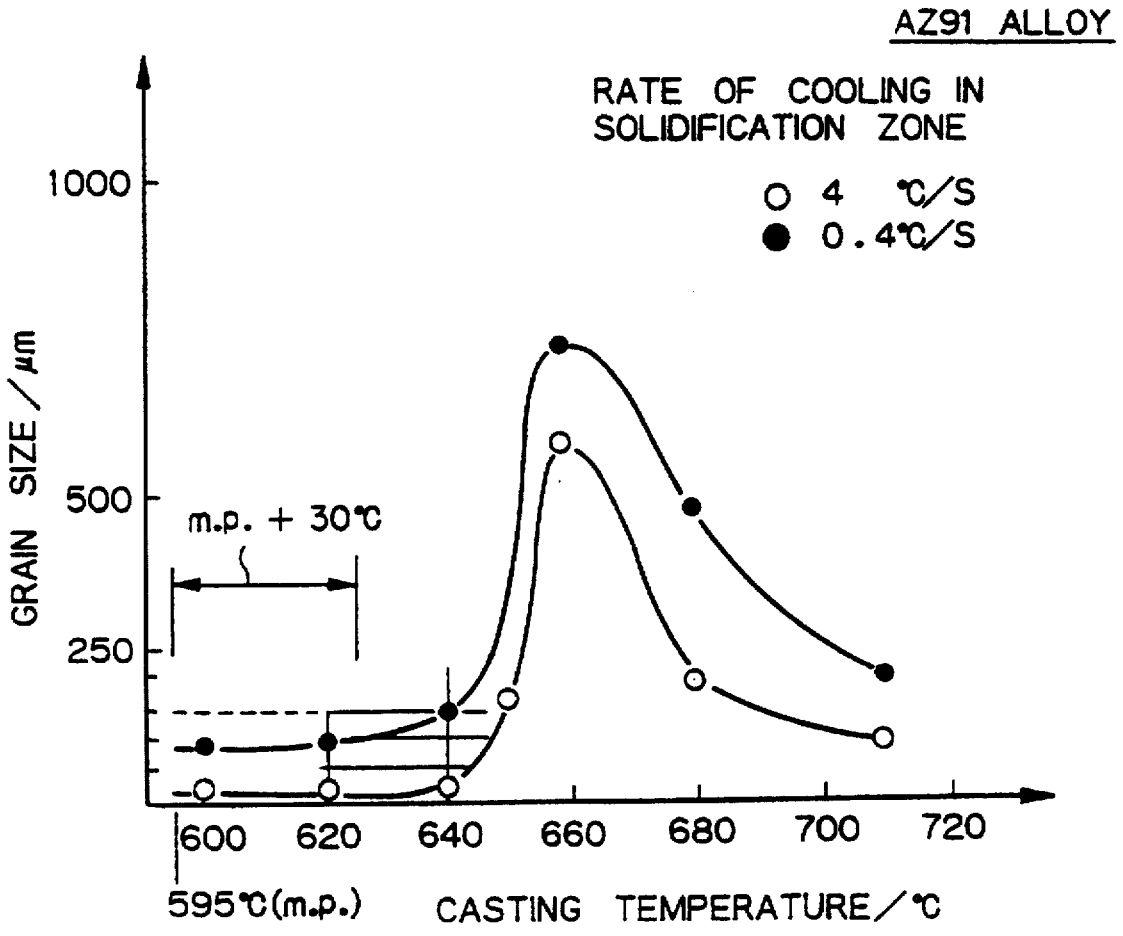
FIG. 21 is a characteristic diagram (graph) showing the correlationship between the crystal grain size and the casting temperature of the magnesium (AZ91) billets that were cast in Example 4.

FIG. 21 is a graph showing the effect of the casting (pouring) temperature on the size of crystal grains in the alloy AZ91 (Mg-9% Al-0.8% Zn-0.2% Mn) for two different rates of cooling in the solidification zone (4° C./sec and 0.4° C./sec), with the casting done in a mold of the design shown in FIG. 14. The curve connecting open circles (○) shows the result of cooling at 4° C./sec whereas the curve connecting dots (●) shows the result of cooling at 0.4° C./sec. Obviously, the size of crystal grains in billets was finer than 100 μm when the casting temperature was selected at levels higher than the melting point of AZ91 (595° C.) by 30° C. or less and, in particular, the grain size was smaller than 50 μm when the rate of cooling in the solidification zone was set at 4° C./sec.

Figure 22:
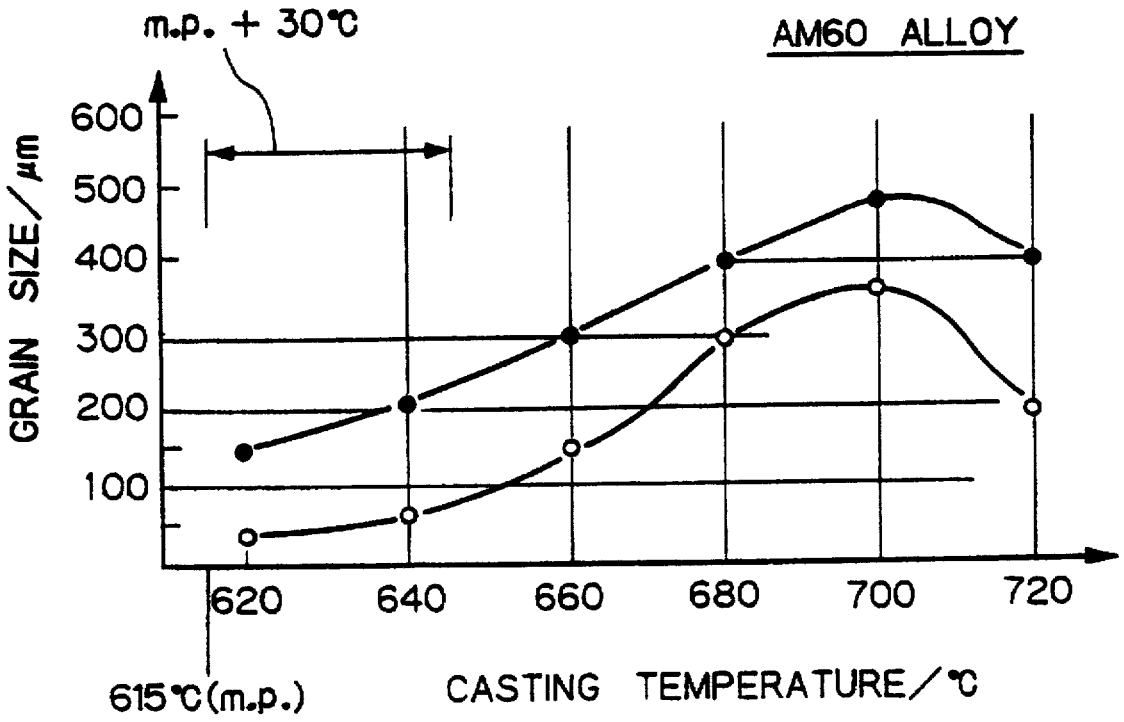
FIG. 22 is a characteristic diagram (graph) showing the correlationship between the crystal grain size and the casting temperature of the magnesium (AM60) billets that were cast in Example 4.

FIG. 22 is a graph similar to FIG. 21, except that the billets were cast from the alloy AM60 (Mg-6% Al-0.2% Mn). The curve connecting open circles (○) shows the result of cooling at 4° C./sec whereas the curve connecting dots (●) shows the result of cooling at 0.4° C./sec Obviously, the size of crystal grains in billets was finer than 200 μm when the casting temperature was set at levels higher than the melting point of AM60 (615° C.) by 30° C. or less and, in particular, the grain size was smaller than 100 μm when the rate of cooling in the solidification zone was set at 4° C./sec.

Magnesium alloys which contain 5–10% Al, 0.1–3.1% Zn and 0.1–0.6% Mn can be used conveniently in the practice of the third aspect of the present invention. If the addition of Al is less than 5%, hot cracking is easy to occur in the billet and if the Al addition exceeds 10%, the mechanical properties will be deteriorated. Therefore, the Al content is set between 5% and 10%. If the Zn content is less than 0.1%, castability will be decreased and if the Zn content exceeds 3.5%, hot cracking is easy to occur. Therefore, the Zn content is set between 0.1% and 3.5%. The addition of Mn improves corrosion resistance; however, if the Mn content is less than 0.1%, the improvement of corrosion resistance cannot be expected and if the Mn content exceeds 0.6%, mechanical properties will decrease and corrosion resistance is saturated. Magnesium alloys containing 5–12% Al and 0.1–0.6% Mn can also be used conveniently in the practice of the third aspect of the present invention.

As will be understood from the foregoing description, the present invention consists of three basis aspects. According to its first aspect, a magnesium or aluminum alloy that have a composition within maximum solubility limits is melted in such a way that its temperature just before casting exceeds the liquidus line of the alloy, but is not higher by more than 30° C. and the melt is then cast at a cooling rate of at least 1.0° C./sec over the solidification zone and the thus cast billet is heated from the solubility line to the solidus line at a rate of at least 0.5° C./min and further heated to a temperature exceeding the solidus line, at which temperature it is held for 5–60 minutes to spheroidize the primary crystals and, thereafter, the billet is heated to a molding temperature below the liquidus line and then molded under pressure.

According to the second aspect of the invention, a hypo-eutectic aluminum alloy having a composition at or above maximum solubility limits is melted and cast as in the first aspect; the thus cast billet is heated to a temperature above the eutectic point of the alloy and the holding temperature and time are selected appropriately to adjust the liquid-phase content to between 20% and 80% so that the primary crystals are spheroidized; subsequently, the semi-solid billet is shaped under pressure. By taking either approach, shaped parts of good quality having a fine-grained and homogeneous thixotropic structure can be produced in a simple and convenient way at low cost without depending upon the conventionally practiced mechanical or electromagnetic stirring.

The third aspect of the invention is a process for preparing an aluminum or magnesium alloy billet suitable for use in semi-solid metal processing; in this process, the melt of an aluminum or a magnesium alloy that is held at a temperature exceeding the liquidus line of the alloy, but not higher by more than 30° C. is cooled at a rate of at least 1.0° C./sec over the solidification zone, thereby yielding a billet having a structure that comprises fine, equiaxed crystal grains. Taking this approach, one can obtain a metal structure that comprises even finer, equiaxed crystals than those produced by the conventional grain refining techniques and which yet is close to the granular structure which is produced by solidification after stirring of a semi-solid billet. Consequently, alloy billets that are suitable for semi-solid metal processing can be prepared in a simple, convenient and yet positive manner in accordance with the invention.

What is claimed is:

1. A method of processing semi-solid metals comprising the steps of:

(a) casting a melt of a magnesium alloy or an aluminum alloy having a composition within maximum solubility limits into a billet-forming mold, the melt being at a temperature as it is cast into said billet-forming mold which exceeds a liquidus line temperature of the alloy, but is not higher by more than 30° C. of the liquidus line temperature;

(b) cooling said melt to solidify said alloy within said billet-forming mold at a cooling rate of at least 1.0° C./sec in a solidification zone to form a billet;

(c) heating said billet within said billet-forming mold from a solubility line temperature to a solidus line temperature of the alloy at a rate of at least 0.5° C./min;

(d) further heating the billet from step (c) to a temperature exceeding the solidus line temperature of the alloy;

(e) maintaining the billet from step (d) at the temperature in step (d) for 5–60 minutes, thereby spheroidizing primary crystals thereof;

(f) further heating said billet from step (e) to a molding temperature below the liquidus line temperature of the alloy to form a semi-solid billet;

(g) feeding the semi-solid billet into a shaping mold; and (h) forming the billet into a shape under pressure.

2. A method of processing semi-solid metals comprising the steps of:

(a) casting a melt of a hypo-eutectic aluminum alloy having a composition at or above maximum solubility limits into a billet-forming mold, the melt being at a temperature as it is cast into said mold which exceeds the liquidus line temperature of the alloy, but is not higher by more than 30° C. of the liquidus line temperature;

(b) cooling said melt to solidify said alloy within said billet-forming mold at a cooling rate of at least 1.0° C./sec in a solidification zone so as to form a billet;

(c) heating said billet to a temperature above the eutectic point of said alloy;

(d) selecting a holding time and a temperature such that the billet has a liquid-phase content of between 20% and 80% and that primary crystals thereof are spheroidized, to form a semi-solid billet;

(e) supplying the semi-solid billet from step (d) to a shaping mold; and (f) forming the billet from step (e) into a shape under pressure.

3. A method according to claim 1 wherein the alloy is a magnesium alloy which contains 0.005–0.1% Sr, a magnesium alloy which contains 0.05–0.3% Ca, or a magnesium alloy which contains 0.01–1.5% Si and 0.005–0.1% Sr.

4. A method according to claim 1 wherein the alloy is an aluminum alloy which contains 0.001–0.01% B and 0.005–0.30% Ti.

5. A method according to claim 2 wherein the aluminum alloy is one which contains 0.001–0.01% B and 0.005–0.30% Ti.

6. A method according to claim 2 wherein the aluminum alloy is one which contains 0.001–0.01% B, 0.005–0.30% Ti and 4–6% Si.

7. A method according to any one of claims 1–6 wherein when the melt is cast into the billet-forming mold small vibrations are applied to said billet-forming mold in a direction generally perpendicular to a direction in which the melt is cast.

8. A method according to claim 1 wherein the cooling rate in the solidification zone is 5° to 10° C./second; and the billet is heated from the solubility line temperature to the solidus line temperature at a heating rate of 50° to 100° C./minute.

9. A method according to claim 1 wherein the alloy is an aluminum alloy which contains 4 to 6% Si and optionally contains at least one of Ti and B.

10. A method according to claim 1 wherein the alloy is a magnesium alloy which optionally contains at least one of Ca, Si and Sr.

11. A method according to claim 1 wherein the alloy is a magnesium alloy which contains 0.01 to 1.5% Si and 0.005 to 0.1% Sr.

12. A method according to claim 2 wherein the liquid-phase content of the billet is 30% to 70%.

13. A process of casting an alloy billet suitable for a semi-solid metal processing method comprising the steps of:

(a) holding a melt of an alloy selected from the group consisting of a magnesium alloy and an aluminum alloy at a temperature exceeding the liquidus line of the alloy, but not higher by more than 30° C.; and (b) casting the melt in a billet-forming mold and cooling at a rate of at least 1.0° C./sec over a solidification zone to form a billet of a structure comprising fine, equiaxed crystal grains.

14. A process according to claim 13 wherein the alloy is a magnesium alloy which contains 5–10% Al, 0.1–3.5% Zn and 0.1–0.6% Mn.

15. A process according to claim 13 wherein the alloy is a magnesium alloy which contains 5–12% Al and 0.1–0.6% Mn.

16. A process according to claim 13 wherein the alloy is an aluminum alloy which contains 0.001–0.01% B and 0.005–0.30% Ti.

17. A process according to claim 13 wherein the alloy is an aluminum alloy which contains 0.001–0.01% B, 0.005–0.30% Ti and 4–6% Si.

18. A process according to any one of claims 13–17 wherein when the melt is cast, small vibrations are applied to said billet-forming mold in a direction generally perpendicular to a direction in which the melt is cast.

19. A method of processing semi-solid metals comprising the steps of:

(a) casting a melt of (i) a magnesium alloy containing 0.005 to 1% Sr or 0.05 to 0.3% Ca or 0.01 to 1.5% Si and 0.005 to 1% Sr or (ii) an aluminum alloy containing 0.001 to 0.01% B and 0.005 to 0.30% Ti or 0.001 to 0.1% B, 0.005 to 0.30% Ti and 4 to 6% Si, and having a composition within maximum solubility limits, into a billet-forming mold, the melt being at a temperature as it is cast into said billet-forming mold which exceeds the liquidus line temperature of the alloy, but is not higher by more than 30° C. of the liquidus line temperature;

(b) cooling said melt to solidify said alloy within said billet-forming mold at a cooling rate of at least 1.0° C./sec in a solidification zone to form a billet;

(c) heating said billet within said billet-forming mold from the solubility line temperature to the solidus line temperature of the alloy at a rate of at least 0.5° C./minute;

(d) further heating the billet from step (c) to a temperature exceeding the solidus line temperature of the alloy;

(e) maintaining the billet from step (d) at the temperature in step (d) for 5 to 60 minutes, thereby spheroidizing primary crystals thereof;

(f) further heating said billet from step (e) to a molding temperature below the liquidus line temperature of the alloy to form a semi-solid billet;

(g) feeding the semi-solid billet from step (f) into a shaping mold; and (h) forming the billet into a shape under pressure.

* * * * *